US006057653A

United States Patent [19]

Miyazaki et al.

[11] Patent Number: 6,057,653

[45] Date of Patent: May 2, 2000

[54] DISCHARGING TUBE WITH VOLTAGE RAISING UNIT AND DISCHARGING UNIT AND DISCHARGING METHOD THEREOF

[75] Inventors: Shingo Miyazaki; Yoshio Shimeki; Akio Sotokawa, all of Kanagawa, Japan

[73] Assignee: Fujitsu Limited, Kawasaki, Japan

[21] Appl. No.: 09/048,021

[22] Filed: Mar. 26, 1998

[30] Foreign Application Priority Data

Jul. 8, 1997 [JP] Japan ..... 9-182893

[51] Int. Cl.[7] ..... H05B 37/00

[52] U.S. Cl. ..... 315/307; 315/224; 315/DIG. 5

[58] Field of Search ..... 315/411, 307, 315/224, DIG. 5, DIG. 7, 219, 291; 313/346 DC

[56] References Cited

U.S. PATENT DOCUMENTS 5,424,620 6/1995 Cheon et al. ..... 315/411
5,548,189 8/1996 Williams ..... 315/224

FOREIGN PATENT DOCUMENTS 7-220888 8/1995 Japan .
7-335386 12/1995 Japan .

*Primary Examiner*—David H. Vu
*Attorney, Agent, or Firm*—Staas & Halsey LLP

[57] ABSTRACT

An object of the present invention is to effectively operate a discharging tube. A voltage raising unit and a discharging unit are disposed in a discharging tube. When a voltage is supplied to the discharging tube, the voltage raising unit raises the voltage to be supplied to the discharging tube. The raised voltage is supplied to the discharging unit. Thus, the discharging unit discharges electricity.

14 Claims, 22 Drawing Sheets

DISCHARGING TUBE WITH VOLTAGE RAISING UNIT AND DISCHARGING UNIT AND DISCHARGING METHOD THEREOF

BACKGROUND OF THE INVENTION

1. Field of the Invention

The present invention relates to a discharging tube and a discharging method thereof, in particular, to a cold cathode fluorescent tube.

2. Description of the Related Art

In recent years, portable information terminal units such as note type personal computers and palm top type personal computers have been widely used.

For display units of these portable information terminal units, liquid crystal display units have been used because of small size, light weight, and low power consumption. For the light source of the back-light of the liquid crystal display unit, a cold cathode tube has been used. To cause the cold cathode tube to emit light, a high AC voltage is required. Thus, with an electromagnetic converting type AC inverter transformer, a high AC voltage is generated and thereby the cold cathode tube emits light.

FIG. 1 is a schematic diagram showing a driving method of a conventional cold cathode tube.

In FIG. 1, a DC voltage of around 10 to 15V is supplied from a DC power supply 271 to an inverter circuit 272. The inverter circuit 272 converts the DC voltage supplied from the DC power supply 271 to a high AC voltage of around 1200V/50 kHz. The resultant high AC voltage is supplied to a cold cathode tube 273. When the high AC voltage is supplied from the inverter circuit 272 to the cold cathode tube 273, the cold cathode tube 273 discharges electricity and emits light.

However, in the conventional driving method of a cold cathode tube, a high voltage wiring line should be connected from the inverter circuit 272 to the cold cathode tube 273. Thus, the voltage supplied from the inverter circuit 272 leaks out through the static stray capacitance of the high voltage wiring line. Thus, the power consumption for driving the cold cathode tube increases. Consequently, when the cold cathode tube is used for the back-light of a portable information terminal unit, the service life of the battery of the portable information terminal unit becomes short.

SUMMARY OF THE INVENTION

An object of the present invention is to provide a discharging tube that is effectively operated.

A discharging tube according to the present invention comprises a transforming unit, a discharging unit, a cathode, an anode, a piezoelectric transformer, a holding unit, a piezoelectric substrate, a primary electrode, a secondary electrode, a driving unit, an outputting unit, and a driving unit.

In a first aspect of the present invention, the piezoelectric unit transforms a voltage that is supplied to the discharging tube. The discharging unit discharges electricity corresponding to the voltage transformed by the transforming unit.

In a second aspect of the present invention, the cathode and the anode are disposed opposite to each other. The piezoelectric transformer transforms the voltage supplied to the anode or the cathode. The holding unit holds the piezoelectric transformer.

In a third aspect of the present invention, the piezoelectric substrate has a first region and a second region. The first region is polarized in the direction of the thickness of the piezoelectric substrate. The second region is polarized in the direction of the length of the piezoelectric substrate. The primary electrodes are disposed on an upper surface and a lower surface of the first region of the piezoelectric substrate. The secondary electrode is disposed on an end surface of the second region of the piezoelectric substrate. In the discharging unit, the secondary electrode is used for the cathode or the anode.

In a fourth aspect of the present invention, the driving unit generates an AC voltage. The transforming unit transforms the AC voltage in the discharging tube. The outputting unit outputs the transformed AC voltage to the cathode or the anode of the discharging tube.

In a fifth aspect of the present invention, the driving circuit generates an AC voltage. The length of the piezoelectric substrate is nearly the same as the length of the discharging tube that has the first region polarized in the direction of the thickness thereof and the second area polarized in the direction of the length thereof. The primary electrodes are disposed on an upper electrode and a lower surface of the first region of the piezoelectric substrate to which the AC voltage is supplied. The secondary electrode is disposed on an end surface of the second region of the piezoelectric substrate.

In a sixth aspect of the present invention, the driving circuit generates an AC voltage. The piezoelectric substrate has a first region and a second region. The first region is polarized in the direction of the thickness of the piezoelectric substrate. The second region is polarized in the direction of the length of the piezoelectric substrate. The section perpendicular to the direction of the length of the piezoelectric substrate is formed in a U-letter shape. The primary electrodes are disposed on an inner surface and an outer surface of the first region of the voltage substrate to which AC voltage is input. The secondary electrode is disposed on an end surface of the second area of the piezoelectric substrate.

These and other objects, features and advantages of the present invention will become more apparent in light of the following detailed description of best mode embodiments thereof, as illustrated in the accompanying drawings.

DESCRIPTION OF PREFERRED EMBODIMENTS

Figure 1:
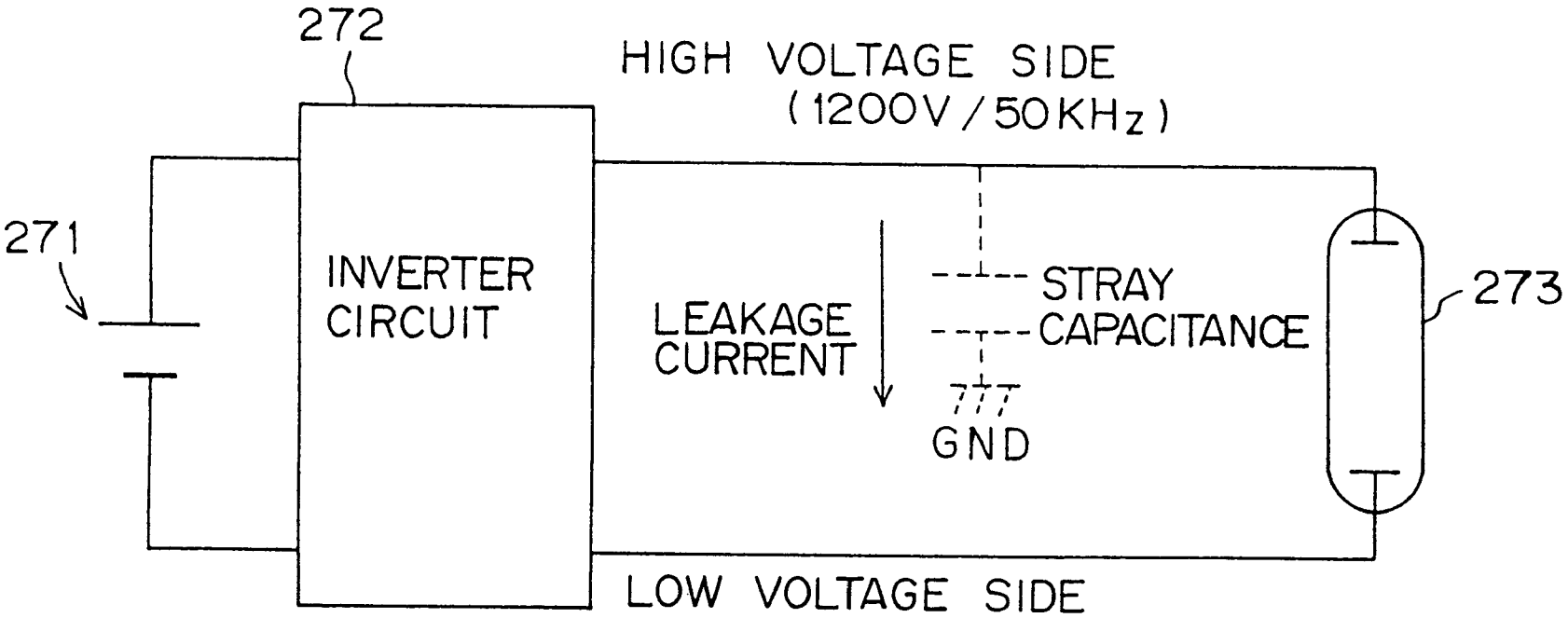
FIG. 1 PRIOR ART
FIG. 1 is a schematic diagram showing an outline structure of a conventional discharging apparatus.

Next, with reference to the accompanying drawings, the present invention will be described.

To solve the above-described problem, according to the present invention, a voltage that is supplied to a discharging tube is raised therein and thereby electricity is discharged therewith.

Thus, only with a low voltage supplied to the discharging tube, electricity can be discharged therefrom. Thus, when a voltage is supplied to the discharging tube, the power leakage out of the discharging tube due to the stray capacitance of a wiring line or the like can be suppressed.

According to an aspect of the present invention, a discharging tube encloses a driving unit that drives a voltage raising unit.

Thus, only with a low DC voltage supplied to the discharging tube, electricity can be discharged by the discharging tube. Consequently, when a voltage is supplied to the discharging tube, the power leakage out of the discharging tube can be further suppressed. Thus, the discharging tube can be more effectively operated.

According to an aspect of the present invention, a discharging tube is a cold cathode tube.

According to an aspect of the present invention, the size and weight of the discharging tube can be reduced. In addition, the discharging tube can be operated with low power consumption.

According to an aspect of the present invention, a voltage raising unit is a piezoelectric transformer.

Thus, a high voltage rise ratio can be easily obtained. Even if the voltage raising unit is disposed in the discharging tube, the size and weight of the discharging tube can be easily reduced. Consequently, the size of the discharging tube can be prevented from increasing.

According to an aspect of the present invention, a discharging unit comprises a cathode and an anode disposed opposite to each other; a piezoelectric transformer for raising a voltage supplied to the cathode or the anode; and an enclosing unit for enclosing the cathode, the anode, and the piezoelectric transformer along with a discharge gas.

Thus, only with a low AC voltage supplied to the discharging tube, a high AC voltage can be easily obtained therein. Consequently, when a voltage is supplied to the discharging tube, the power leakage out of the discharging tube can be suppressed. Consequently, the power consumption of the discharging tube can be reduced.

In addition, according to an aspect of the present invention, a piezoelectric transformer is held at a node of a vibration.

Thus, the piezoelectric transformer can be held in the discharging tube without a decrease of an output voltage of the piezoelectric transformer. Consequently, the voltage can be effectively raised in the discharging tube.

In addition, according to an aspect of the present invention, a driving circuit that drives a piezoelectric transformer is enclosed in a discharging tube.

Thus, a DC voltage can be converted into an AC voltage in the discharging tube. Moreover, a high AC voltage can be easily obtained in the discharging tube. Only with a DC voltage supplied to the discharging tube, electricity can be discharged by the discharging tube. Consequently, the power leakage out of the discharging tube can be further suppressed. Thus, the power consumption of the discharging tube can be further reduced.

According to an aspect of the present invention, a pattern of a driving circuit is formed on a piezoelectric transformer.

Thus, even if the driving circuit is disposed in a discharging tube, the size of the discharge tube can be prevented from increasing. Thus, the size and weight of the discharging tube can be reduced. In addition, the discharging tube can be effectively operated.

In addition, according to an aspect of the present invention, a driving circuit comprises an oscillating circuit and a feedback circuit. The feedback circuit feeds back an output of the piezoelectric transformer.

Thus, corresponding to the characteristics in the real operating state of the piezoelectric transformer, the driving conditions of the piezoelectric transformer can be varied. Consequently, a decrease of the voltage rise ratio of the piezoelectric transformer due to a variation of the operating state of the piezoelectric transformer can be prevented.

In addition, according to an aspect of the present invention, the oscillation frequency of an oscillating circuit is varied corresponding to the variation of the resonant frequency of the piezoelectric transformer.

Thus, even if the resonant characteristics of a piezoelectric transformer vary due to variations of the level of a drive signal, temperature, load, and so forth, the piezoelectric transformer can be driven at an optimum frequency. Consequently, the piezoelectric transformer can be effectively operated.

In addition, according to an aspect of the present invention, a discharging tube comprises a piezoelectric substrate, primary electrodes, and a secondary electrode. The piezoelectric substrate has a first region and a second region. The first region is polarized in the direction of the thickness of the piezoelectric substrate. The second region is polarized in the direction of the length of the piezoelectric substrate. The primary electrodes are disposed on an upper surface and a lower surface of the first region. The secondary electrode is disposed on an end surface of the second region. The secondary electrode is used for a cathode or an anode of the discharging tube.

Thus, when the piezoelectric transformer is held in the discharging tube, at least one of the cathode or the anode of the discharging tube can be omitted. Consequently, the power consumption of the discharging tube can be reduced. In addition, the size and weight of the discharging tube can be reduced.

In addition, according to an aspect of the present invention, a secondary electrode is enclosed in a discharging tube. A primary electrode is disposed outside the discharging tube.

Thus, the size of the discharging tube can be reduced. Even if a driving circuit that drives a piezoelectric transformer is disposed on a piezoelectric substrate and thereby the length of a wiring line is decreased, the driving circuit can be disposed outside the discharging tube. Consequently, the driving circuit is protected from the electricity discharged in the discharging tube.

In addition, according to an aspect of the present invention, the length of a piezoelectric substrate is substantially the same as the length of a discharging tube.

Thus, since the length of a high voltage wiring line can be decreased, the power leakage out of the discharging tube due to the stray capacitance of the wiring line or the like can be suppressed. Consequently, the discharging tube can be effectively operated.

In addition, according to an aspect of the present invention, piezoelectric transformers are disposed for an anode and a cathode of a discharging tube. The piezoelectric transformers for the anode and cathode are driven with AC voltages whose phases are opposite to each other.

Thus, the potential between the anode and the cathode of the discharging tube can be increased. Consequently, electricity can be effectively discharged in the discharging tube.

In addition, according to an aspect of the present invention, a piezoelectric transformer with a length substantially the same as a length of a discharging tube is used for an inverter that drives the discharging tube.

Thus, the length of the wiring line connected between the secondary electrode of the piezoelectric transformer and the cathode or the anode of the discharging tube can be decreased. Consequently, the power leakage out of the discharging tube due to the stray capacitance of the wiring line or the like can be reduced. Thus, the discharging tube can be effectively operated.

In addition, according to an aspect of the present invention, a piezoelectric transformer with a U-letter shaped section perpendicular to the direction of the length thereof is used for an inverter that drives the discharging tube.

Thus, the piezoelectric transformer can be used as a lamp holder. Moreover, the length of the wiring line connected between the secondary electrode of the piezoelectric transformer and the cathode or the anode of the discharging tube can be decreased. Consequently, light emitted from the discharging tube can be effectively used. Furthermore, the power consumption of the discharging tube can be reduced.

Figure 2A:
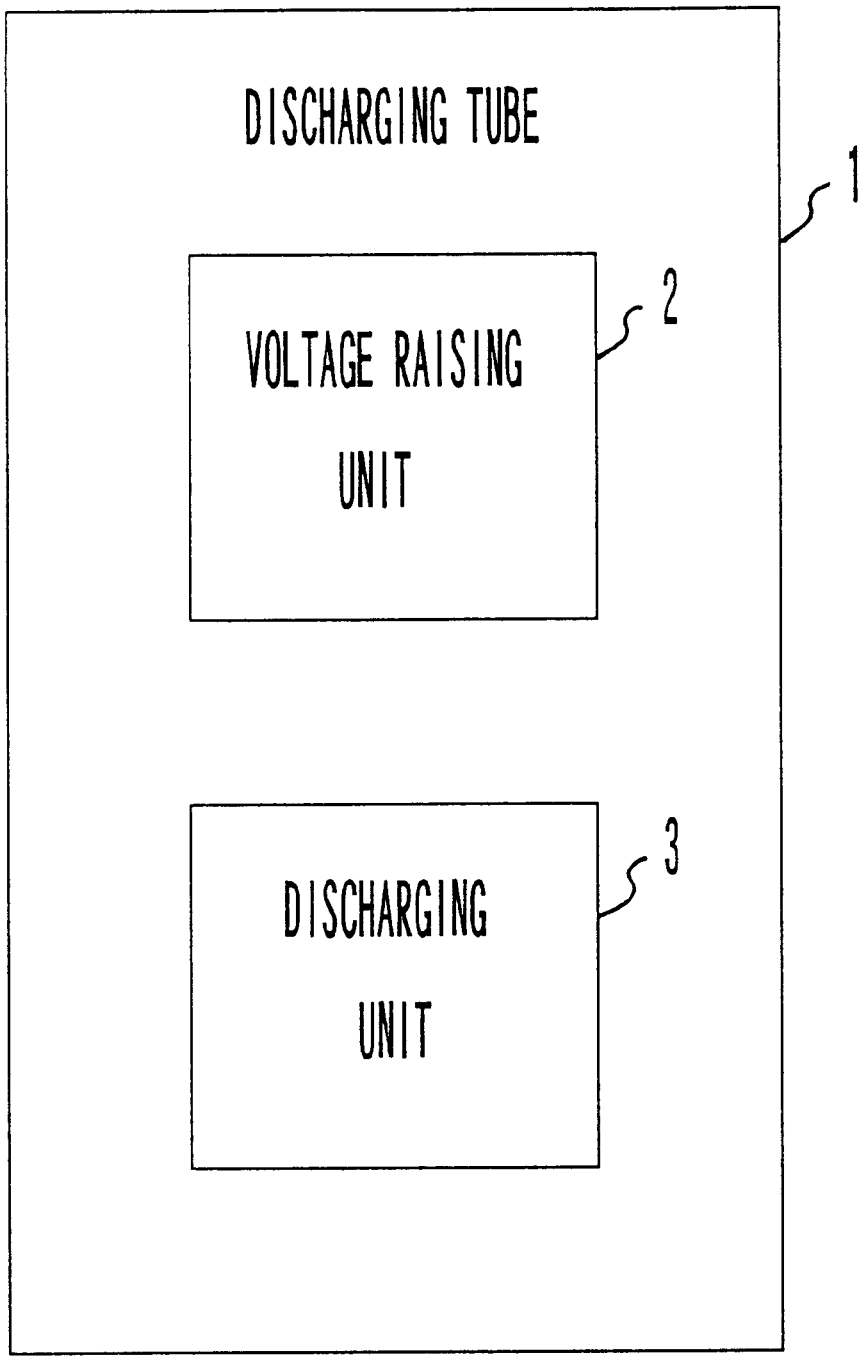
FIG. 2A is a block diagram showing a functional structure of a discharging tube according to a first embodiment of the present invention.

FIG. 2A is a block diagram showing a functional structure of a discharging tube according to a first embodiment of the present invention.

In the discharging tube according to the first embodiment, a voltage supplied to the discharging tube is raised therewith.

In FIG. 2A, a discharging tube 1 comprises a voltage raising unit 2 and a discharging unit 3. When a voltage is supplied to the discharging tube 1, the voltage raising unit 2 raises the voltage supplied thereto. The raised voltage is supplied to the discharging unit 3. Thus, the discharging tube 1 discharges electricity.

The discharging tube 1 is, for example, a cold cathode tube. The voltage raising unit 2 is, for example, a piezoelectric transformer. The discharging tube 1 may be, for example, a hot cathode tube (such as a fluorescent lamp), a mercury lamp, a metal halide lamp, a sodium lamp, or a xenon lamp. The voltage raising unit 2 may be an electromagnetic converting transformer.

Thus, with the voltage raising unit 2 disposed in the discharging tube 1, only with a low voltage supplied to the discharging tube 1, electricity can be discharged in the discharging tube. Consequently, a high voltage wiring line can be omitted from the discharging tube. Thus, the power consumption for causing the discharging tube to emit light can be reduced.

Figure 2B:
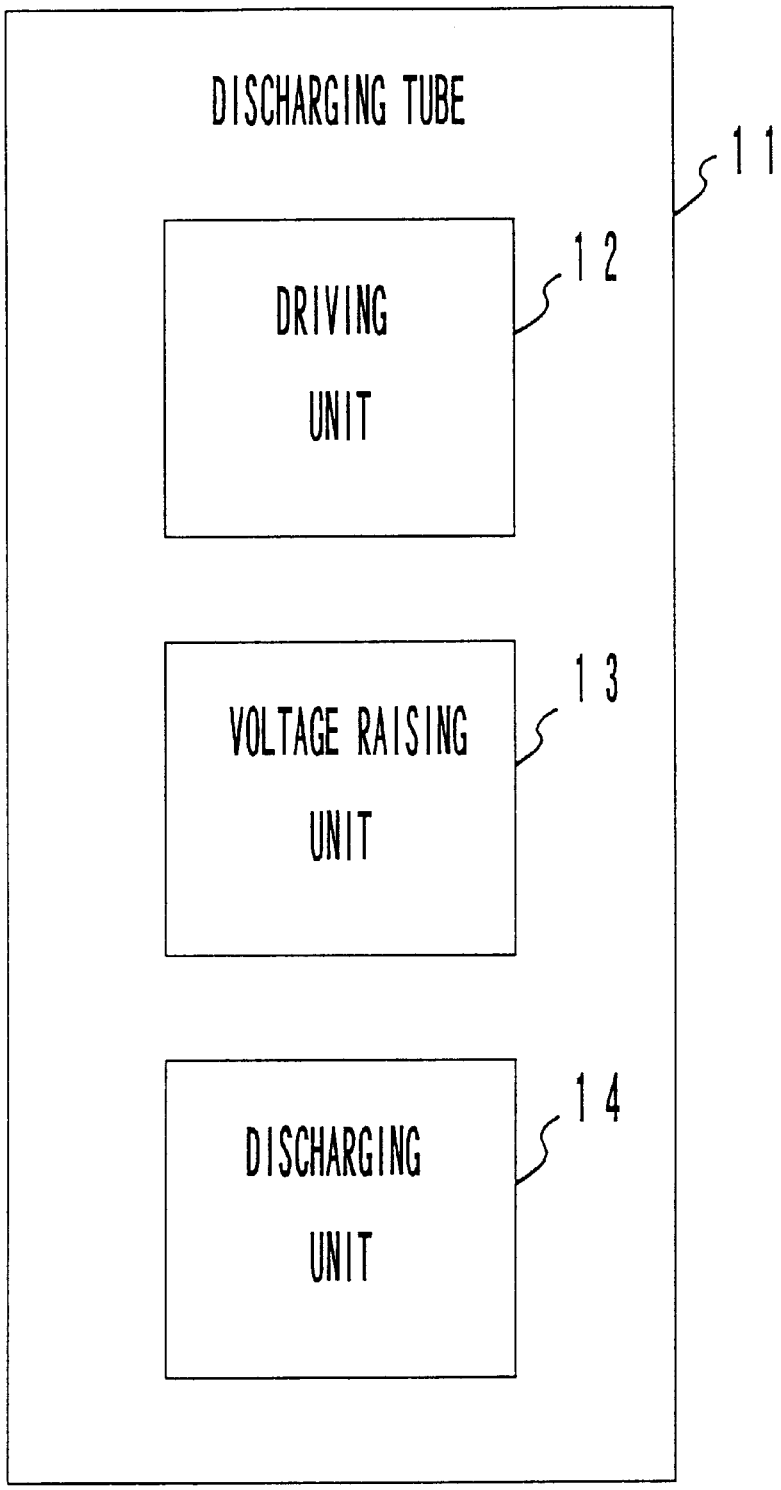
FIG. 2B is a block diagram showing a functional structure of a discharging tube according to a second embodiment of the present invention.

FIG. 2B is a block diagram showing a functional structure of a discharging tube according to a second embodiment of the present invention.

In the discharging tube according to the second embodiment, a voltage supplied to the discharging tube is raised inside the discharging tube. In addition, a drive signal for driving the discharging tube is generated inside the discharging tube.

In FIG. 2B, a discharging tube 11 comprises a driving unit 12, a voltage raising unit 13, and a discharging unit 14. When a voltage is supplied to the discharging tube 11, the driving unit 12 generates a signal for driving the voltage raising unit 13 corresponding to the voltage supplied to the discharging tube 11. The signal generated by the driving unit 12 is raised by the voltage raising unit 13. The resultant signal is supplied to the discharging unit 13 and thereby electricity is discharged in the discharging tube 11.

The discharging tube 11 is, for example, a cold cathode tube. The driving unit 12 is, for example, an oscillating circuit. The voltage raising unit 13 is, for example, a piezoelectric transformer.

Since the driving unit 12 and the voltage raising unit 13 are disposed in the discharging tube 11, only with a DC voltage supplied to the discharging unit, electricity can be discharged in the discharging tube. Thus, it is not necessary to supply an AC voltage to the discharging tube. Consequently, the power leakage out of the discharging tube due to a stray capacitance can be almost prevented. Thus, the power consumption for causing the discharging tube to emit light can be further reduced.

Figure 3:
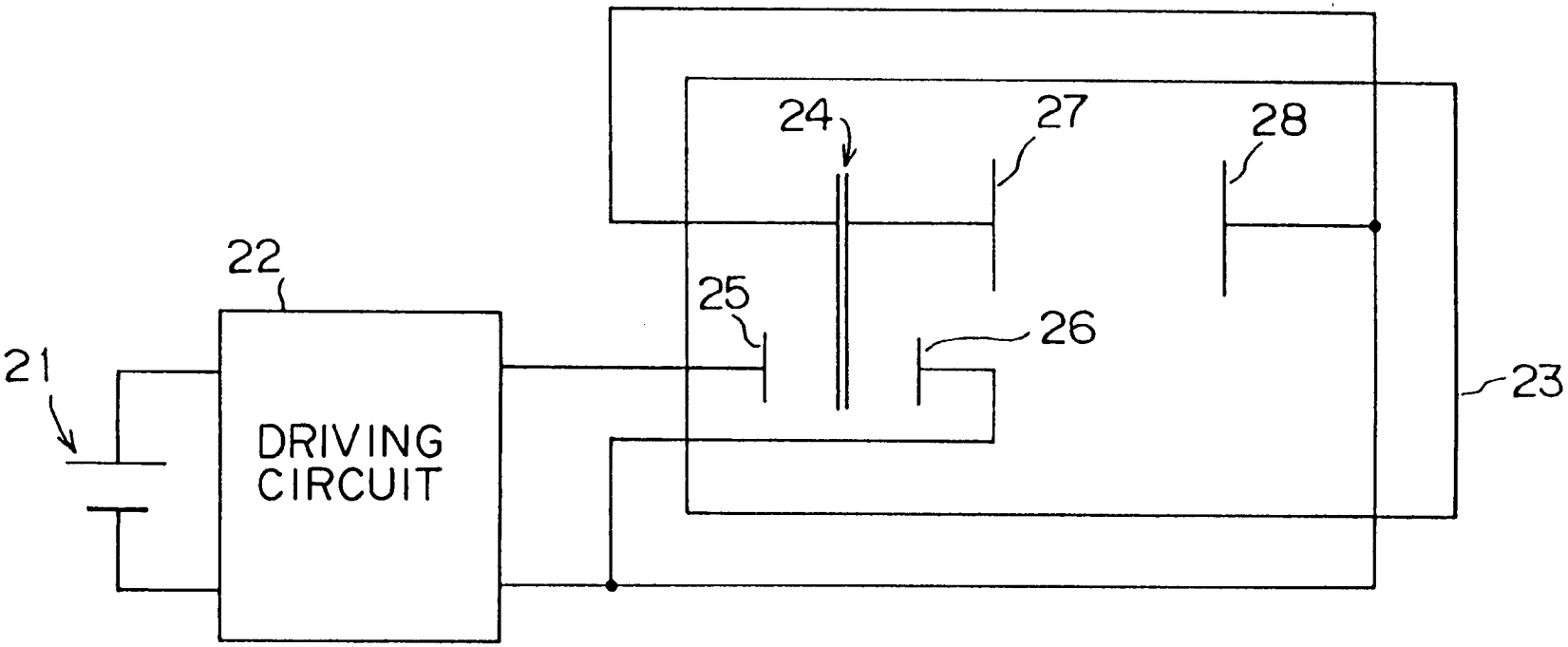
FIG. 3 is a schematic diagram showing a discharging apparatus according to a third embodiment of the present invention.

FIG. 3 is a schematic diagram showing an outline structure of a discharging apparatus according to a third embodiment of the present invention. The discharging apparatus according to the third embodiment encloses a piezoelectric transformer. Thus, a voltage necessary for causing a cold cathode tube to discharge electricity is obtained in the discharging apparatus.

In FIG. 3, a piezoelectric substrate 24, primary electrodes 25 and 26, a secondary electrode 27, and a cathode 28 are enclosed in a cold cathode tube 23 along with a discharge gas. The primary electrodes 25 and 26 drive the piezoelectric substrate 24. The secondary electrode 27 outputs a voltage generated by the piezoelectric substrate 24. The secondary electrode 27 and the cathode 28 are held so that they are disposed opposite to each other with a predetermined distance. A DC power supply 21 is connected on the input side of a driving circuit 22. The primary electrode 25 is connected to one terminal on the output side of the driving circuit 22. The primary electrode 26, the cathode 28, and a ground point of the piezoelectric substrate 24 are connected to the other terminal on the output side of the driving circuit 22.

When the DC power supply 21 supplies a DC voltage of around 10V to the driving circuit 22, the driving circuit 22 converts the DC voltage into an AC voltage with a frequency ranging from 40 to 60 kHz. The resultant AC voltage is supplied to the primary electrode 25. When the AC voltage is supplied between the primary electrode 25 and the primary electrode 26, the piezoelectric substrate 24 raises the AC voltage to around 1200V and supplies the raised voltage to the secondary electrode 27.

The secondary electrode 27 forms the anode of the cold cathode tube 23. With the voltage raising effect of the piezoelectric transformer, a high AC voltage of around 1200V with a frequency ranging from 40 to 60 kHz is generated between the secondary electrode 27 and the cathode 28. Thus, the cold cathode tube 23 discharges electricity that causes mercury gas in the cold cathode tube 23 to irradiate ultraviolet rays. The ultraviolet rays activate a phosphor coated on an inner surface of the cold cathode tube 23 and cause the cold cathode tube 23 to emit light.

Figure 4:
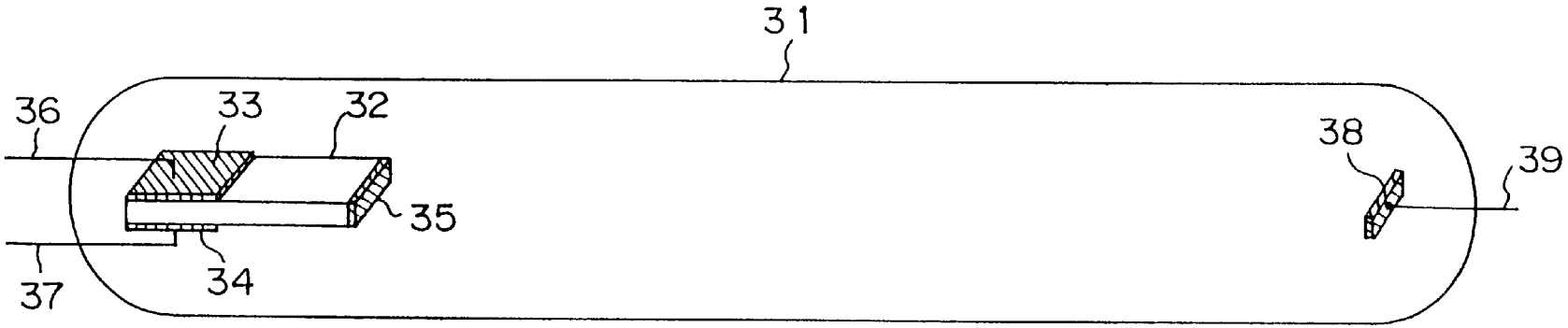
FIG. 4 is an isometric view showing an example of the structure of a cold cathode tube shown in FIG. 3.

FIG. 4 is an isometric view showing a practical example of the structure of the cold cathode tube 23 shown in FIG. 3.

In FIG. 4, a pair of primary electrodes 33 and 34 are formed on an upper surface and a lower surface of one portion of a rectangular plate-shaped piezoelectric substrate 32. A secondary electrode 35 is formed on one end surface of the other portion of the piezoelectric substrate 32. A lead line 36 is disposed at the primary electrode 33. A lead line 37 is disposed at the primary electrode 34. The lead lines 36 and 37 are secured to one end of the cold cathode tube 31 so that the piezoelectric substrate 32 is held in the cold cathode tube 31. A cathode 38 is held at the other end of the cold cathode tube 31 by a lead line 39. Since the secondary electrode 35 of the piezoelectric substrate 32 and the cathode 38 are disposed opposite to each other, the secondary electrode 35 of the piezoelectric substrate 32 is used as an anode of the cold cathode tube 31.

Thus, electricity is discharged between the secondary electrode 35 of the piezoelectric substrate 32 and the cathode 38 in the cold cathode tube 31. Consequently, when the piezoelectric transformer is disposed in the cold cathode tube 31, the anode of the cold cathode tube 31 can be omitted. Thus, the size and weight of the cold cathode tube 31 can be reduced.

In the structure that the lead lines 36 and 37 are thinly formed in such a manner that they bend corresponding to the vibrations of the piezoelectric substrate 32, when the piezoelectric substrate 32 is held by the lead lines 36 and 37, the influence of vibration to the piezoelectric substrate 32 can be suppressed. Alternatively, with the lead lines 36 and 37 formed in a spring shape, the influence of vibration to the piezoelectric substrate 32 can be suppressed.

FIGS. 5A to 5D are schematic diagrams for explaining vibration modes of a piezoelectric transform according to an embodiment of the present invention.

Figure 5A:
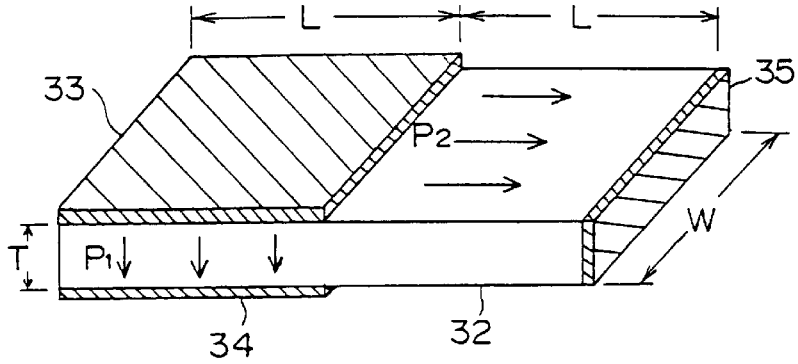
FIGS. 5A to 5D are schematic diagrams for explaining a vibration mode of a piezoelectric transformer according to an embodiment of the present invention.
Figure 5B:
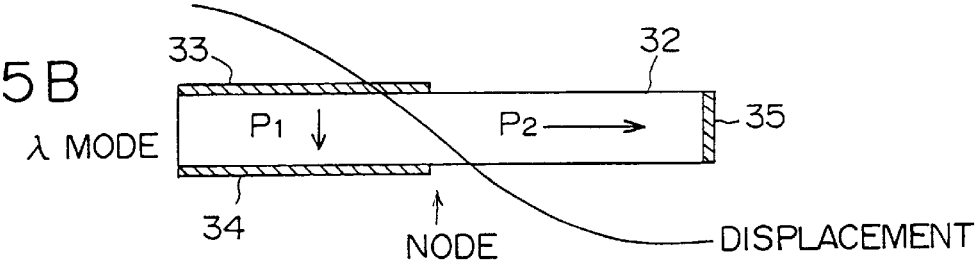
Figure 5C:
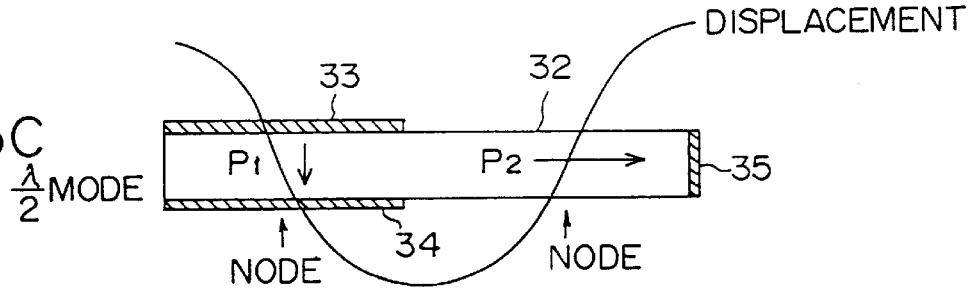
Figure 5D:
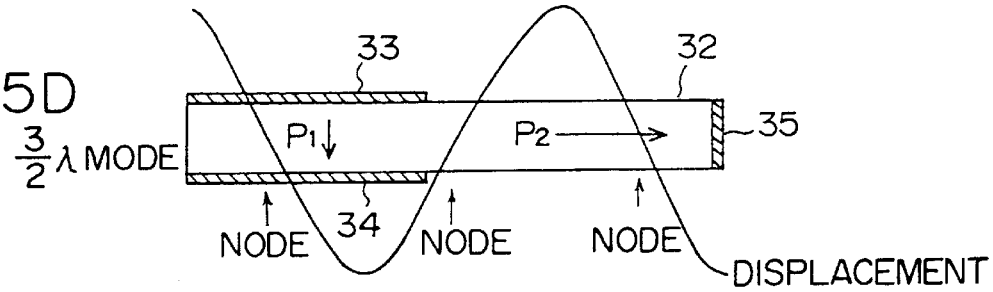

In FIG. 5A, a piezoelectric substrate 32 is formed in a rectangular plate shape with a length of 2L, a width of W, and a thickness of T. One portion of the piezoelectric substrate 32 is polarized in the direction of the thickness thereof. The polarity of this portion is denoted by P1. The other portion of the piezoelectric substrate 32 is polarized in the direction of the length thereof. The polarity of the other portion is denoted by P2. A pair of primary electrodes 33 and 34 are disposed on an upper surface and a lower surface of one portion (polarized as P1) of the piezoelectric substrate 32. A secondary electrode 35 is disposed on an end surface in direction of the length of the other portion (polarized as P2) of the piezoelectric substrate 32.

As examples of the material of the piezoelectric substrate 32, a piezoelectric crystal material and a piezoelectric ceramic material can be used. As an example of the piezoelectric crystal material, lithium niobate can be used. As examples of the piezoelectric ceramic material, barium titanate ($BaTiO_3$) type ceramics, lead titanate ($PbTiO_3$) type ceramics, lead zirconate titanate (PZT) type ceramics, and three-component type ceramics can be used.

When an input voltage V1 with a characteristic resonant frequency that depends on the length 2L of the piezoelectric substrate 32 is supplied to the primary electrodes 33 and 34, a mechanical vibration due to an electrostriction effect of the piezoelectric substrate 32 takes place. The mechanical vibration increases in the direction of the length of the piezoelectric substrate 32. Due to the piezoelectric effect, a high AC voltage V2 is generated at the secondary electrode 35. In other words, the piezoelectric transformer converts electric energy into a mechanical vibration. After the mechanical vibration is strengthened, the resultant vibration is restored to electric energy. Accordingly, the voltage is raised.

As shown in FIGS. 5A to 5D, the piezoelectric transformer has vibration modes such as λ (full-wave vibration) mode, λ/2 (half-wave vibration) mode, and 3 λ/2 mode. The distribution of the displacement of the vibration deviates corresponding to each mode. In addition, each mode has a node at which the amplitude of the vibration is 0 or minimal. Thus, to effectively operate the piezoelectric transformer, it should be held at a node of the vibration thereof.

When no load is applied to an output terminal, the voltage rise ratio V2/V1 is given by the following formula.

$$V2/V1=4/\pi 2\cdot Qm\cdot k31\cdot k33\cdot L/T \quad (1)$$

where Qm is a mechanical quality coefficient; and k31 and k33 are piezoelectric constants.

In addition, the fundamental resonance frequency fr is given by the following formula.

$$fr=c/(4L) \quad (2)$$

where c is the sound velocity in the piezodectric substrate 32.

When the piezoelectric substrate 32 is composed of lead zirconate titanate type ceramics, a voltage rise ratio V2/V1 of several hundred times can be obtained.

Thus, when a piezoelectric transformer is disposed in the cold cathode tube 23, only with an AC voltage supplied to the cold cathode tube 23, a high AC voltage can be easily obtained in the cold cathode tube 23. Consequently, the power consumption of the cold cathode tube 23 can be reduced. In addition, the size of the cold cathode tube 23 can be prevented from increasing. Thus, when the cold cathode tube 23 is used as a back-light of a liquid crystal display or the like, the power consumption can be reduced without increasing the size and weight of the liquid crystal display.

Figure 6:
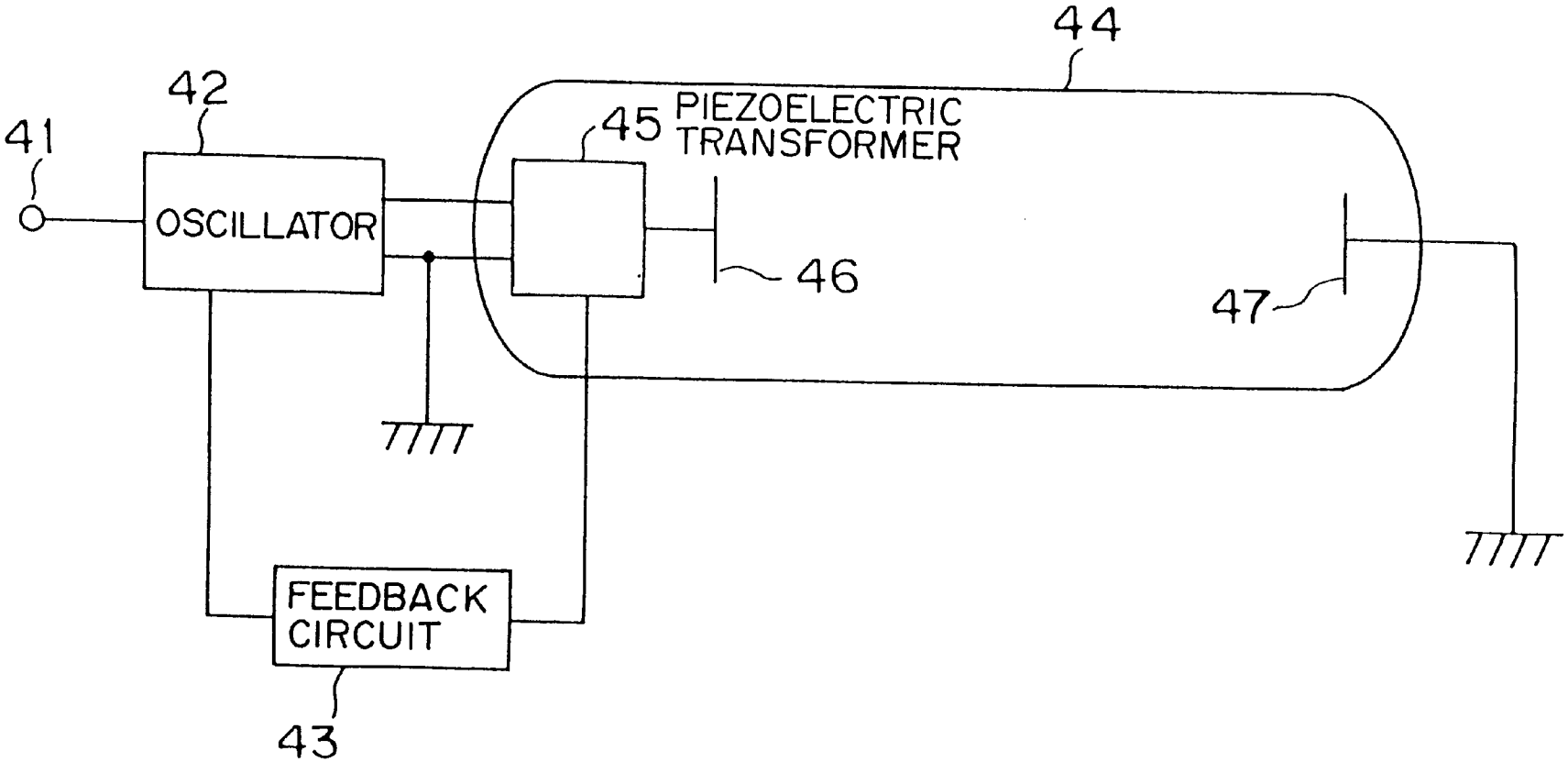
FIG. 6 is a schematic diagram showing an example of a first structure of the discharging apparatus shown in FIG. 3.

FIG. 6 is a schematic diagram showing a first example of the structure of the discharging apparatus shown in FIG. 3.

In FIG. 6, a piezoelectric transformer 45 is disposed in a cold cathode tube 44. An anode 46 of the cold cathode tube 44 is connected to a secondary electrode of the piezoelectric transformer 45. A cathode 47 of the cold cathode tube 44 is grounded. An output terminal of an oscillator 42 is connected to a first primary electrode of the piezoelectric transformer 45. A second primary electrode of the piezoelectric transformer 45 is grounded. Part of an output of the piezoelectric transformer 45 is fed back to the oscillator 42 through a feedback circuit 43. The oscillator 42 adjusts its output corresponding to a feedback signal received from the feedback circuit 43 so that the piezoelectric transformer 45 is operated in optimum conditions.

When a DC voltage is supplied to a DC voltage input terminal 41, the oscillator 42 is operated. Thus, the oscillator 42 supplies an AC voltage with a predetermined frequency to the piezoelectric transformer 45. The piezoelectric transformer 45 raises the AC voltage received from the oscillator 42 and supplies the resultant AC voltage to the anode 46. When the high AC voltage is supplied between the anode 46 and the cathode 47 by the piezoelectric transformer 45, the cold cathode tube 44 discharges electricity that causes mercury gas in the cold cathode tube 44 to irradiate ultraviolet rays. The ultraviolet rays activate a phosphor coated on an inner surface of the cold cathode tube 44 and cause the cold cathode tube 44 to emit light.

The output characteristics of the piezoelectric transformer 45 vary depending on whether or not a load is applied thereto. Thus, in the case that the piezoelectric transformer 45 is operated corresponding to the non-load state thereof, when a load is applied to the piezoelectric transformer 45, the output voltage thereof lowers. To prevent this problem, part of the output of the piezoelectric transformer 45 is fed back to the oscillator 42 so as to vary the oscillating state of the oscillator 42 in such a manner that the piezoelectric transformer 45 is most effectively operated.

Thus, when part of the output of the piezoelectric transformer 45 is fed back to the oscillator 42, the operating condition of the piezoelectric transformer 45 can be varied corresponding to the characteristics of the operating state of the piezoelectric transformer 45. Consequently, the decrease of the voltage rise ratio of the piezoelectric transformer 45 due to the variation of the operating state of the piezoelectric transformer 45 can be prevented.

Figure 7:
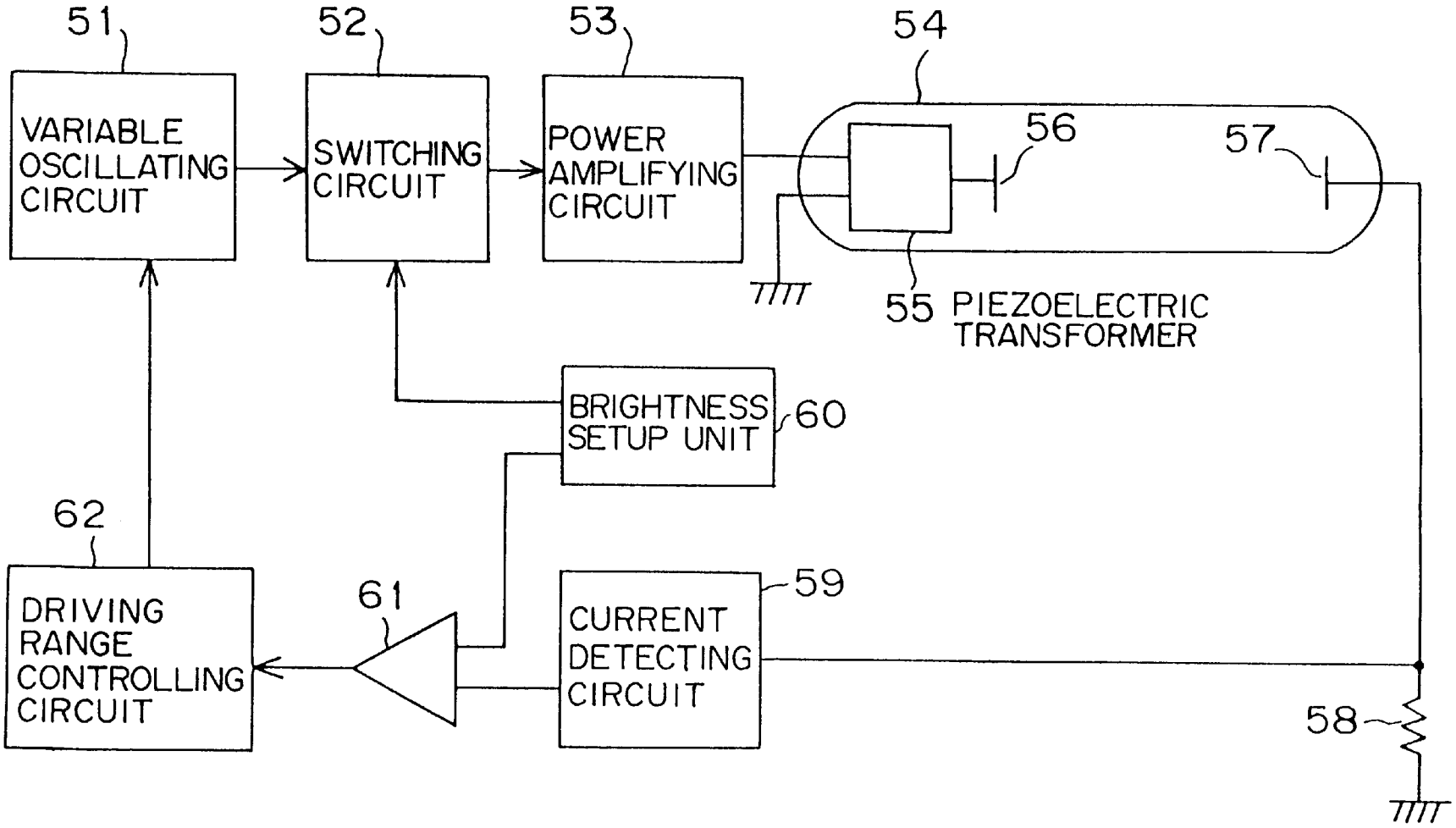
FIG. 7 is a schematic diagram showing an example of a second structure of the discharging apparatus shown in FIG. 3.

FIG. 7 is a schematic diagram showing a second example of the structure of the discharging apparatus shown in FIG. 3.

In FIG. 7, a variable oscillating circuit 51, a switching circuit 52, and a power amplifying circuit 53 are tandem-connected. A piezoelectric transformer 55 is disposed in a cold cathode tube 54. An anode 56 of the cold cathode tube 54 is connected to a secondary electrode of a piezoelectric transformer 55. A cathode 57 of the cold cathode tube 54 is grounded through a resistor 58. An output terminal of the power amplifying circuit 53 is connected to one primary electrode of the piezoelectric transformer 55. The other primary electrode of the piezoelectric transformer 55 is grounded. An input terminal of a current detecting circuit 59 is connected between the cathode 57 of the cold cathode tube 54 and the resistor 58. An output signal of a brightness setup unit 60 and an output signal of the current detecting circuit 59 are supplied to a comparing circuit 61. An output signal of the comparing circuit 61 is supplied to a drive range controlling circuit 62. An output signal of the drive range controlling circuit 62 is supplied to the variable oscillating circuit 51 so as to control the oscillation frequency of the variable oscillating circuit 51.

When an AC voltage is supplied from the variable oscillating circuit 51 to the piezoelectric transformer 55 through the switching circuit 52 and the power amplifying circuit 53, the piezoelectric transformer 55 raises the AC voltage received from the variable oscillating circuit 51 and supplies the resultant AC voltage to the anode 56 of the cold cathode tube 54. When the high AC voltage is supplied between the anode 56 and the cathode 57 by the piezoelectric transformer 55, the cold cathode tube 54 discharges electricity that causes mercury gas in the cold cathode tube 54 to irradiate ultraviolet rays. The ultraviolet rays activate a phosphor coated on an inner surface of the cold cathode tube 54 and causes the cold cathode tube 54 to emit light.

The resonance characteristics of the piezoelectric transformer 55 vary corresponding to the variations of the level of the drive signal, temperature, load, and so forth. In other words, as the level of the drive signal becomes high, the non-linearity and resonant resistance increase. In addition, the resonant frequency and mechanical quality coefficient Qm decrease. Moreover, as the level of the drive signal becomes high, the temperature of the piezoelectric transformer 55 rises. Thus, such phenomena accelerate. The voltage rise ratio of the piezoelectric transformer 55 is high at the resonant frequency. However, when the piezoelectric transformer 55 deviates from the resonant frequency, the voltage rise ratio thereof decreases. Thus, as expressed by the above formula (1), the voltage rise ratio of the piezoelectric transformer 55 is proportional to the mechanical quality coefficient Qm.

Consequently, the current detecting circuit 59 detects the current that flows in the cold cathode tube 54. The drive range controlling circuit 62 controls the oscillation frequency of the variable oscillating circuit 51 so that the current that flows in the cold cathode tube 54 becomes constant. Even if the resonant characteristics of the piezoelectric transformer vary due to the variations of the level of the drive signal, temperature, load, and so forth, the piezoelectric transformer is operated at an optimum frequency. Thus, the piezoelectric transformer is effectively operated.

Figure 8:
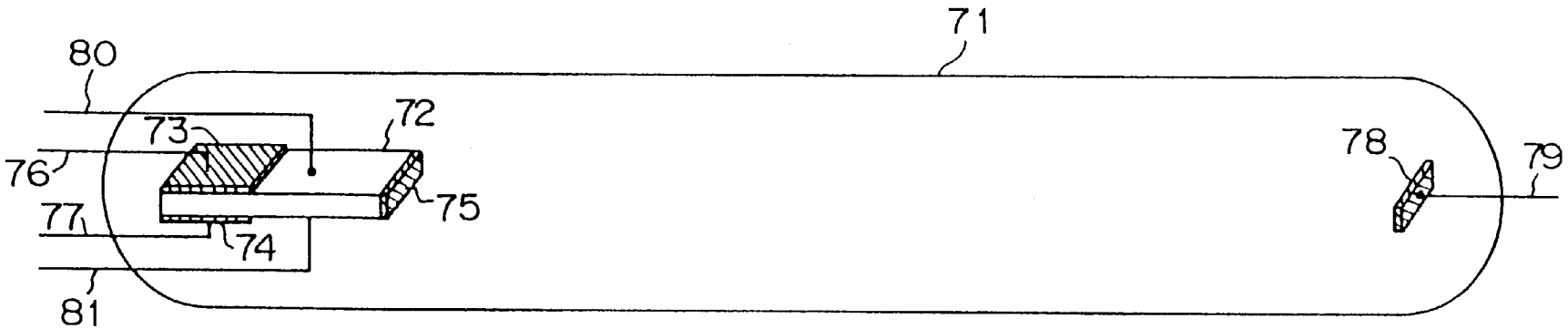
FIG. 8 is an isometric view showing an outline structure of a cold cathode tube according to a fourth embodiment of the present invention.

FIG. 8 is an isometric view showing an outline structure of a cold cathode tube according to a fourth embodiment of the present invention.

In the fourth embodiment, an example of the method for holding a piezoelectric transformer in a cold cathode tube is provided. In the fourth embodiment, the piezoelectric transformer is held at a node of a vibration thereof.

In FIG. 8, a pair of primary electrodes 73 and 74 are formed on an upper surface and a lower surface of one portion of a rectangular plate-shaped piezoelectric substrate 72. A secondary electrode 75 is formed on an end surface of the other portion of the piezoelectric substrate 72. A lead line 76 is disposed at the primary electrode 73. A lead line 77 is disposed at the primary electrode 74. The lead lines 76 and 77 are composed of a soft material or flexibly structured so as to prevent them from affecting the vibration of the piezoelectric substrate 72. The piezoelectric substrate 72 is held by holding members 80 and 81. The holding members 80 and 81 are secured at one end of a cold cathode tube 71 so as to hold the piezoelectric substrate 72 in the cold cathode tube 71.

The holding members 80 and 81 hold the piezoelectric substrate 72 at a node of the vibration thereof so as to prevent the holding members 80 and 81 from affecting the vibration of the piezoelectric substrate 72. The holding members 80 and 81 are preferably composed of an insulator such as glass or plastic. Alternatively, the piezoelectric substrate 72 may be held at three or more positions. A cathode 78 of the cold cathode tube 71 is held with a lead line 79 at the other end of the cold cathode tube 71. A secondary electrode 75 of the piezoelectric substrate 72 is disposed opposite to the cathode 78. The secondary electrode 75 of the piezoelectric substrate 72 forms an anode of the cold cathode tube 71. Thus, electricity is discharged between the secondary electrode 75 of the piezoelectric substrate 72 and the cathode 78 in the cold cathode tube 71. Since the anode of the cold cathode tube 71 is omitted, the size and weight of the cold cathode tube 71 can be reduced.

Since the piezoelectric transformer is held at a node of the vibration of the piezoelectric transformer, it can be held inside the cold cathode tube 71 without a decrease of the output voltage of the piezoelectric transformer. Thus, the voltage can be effectively raised in the cold cathode tube 71.

Alternatively, the piezoelectric substrate 72 may be held in the lateral direction thereof rather than the vertical direction thereof.

Figure 9:
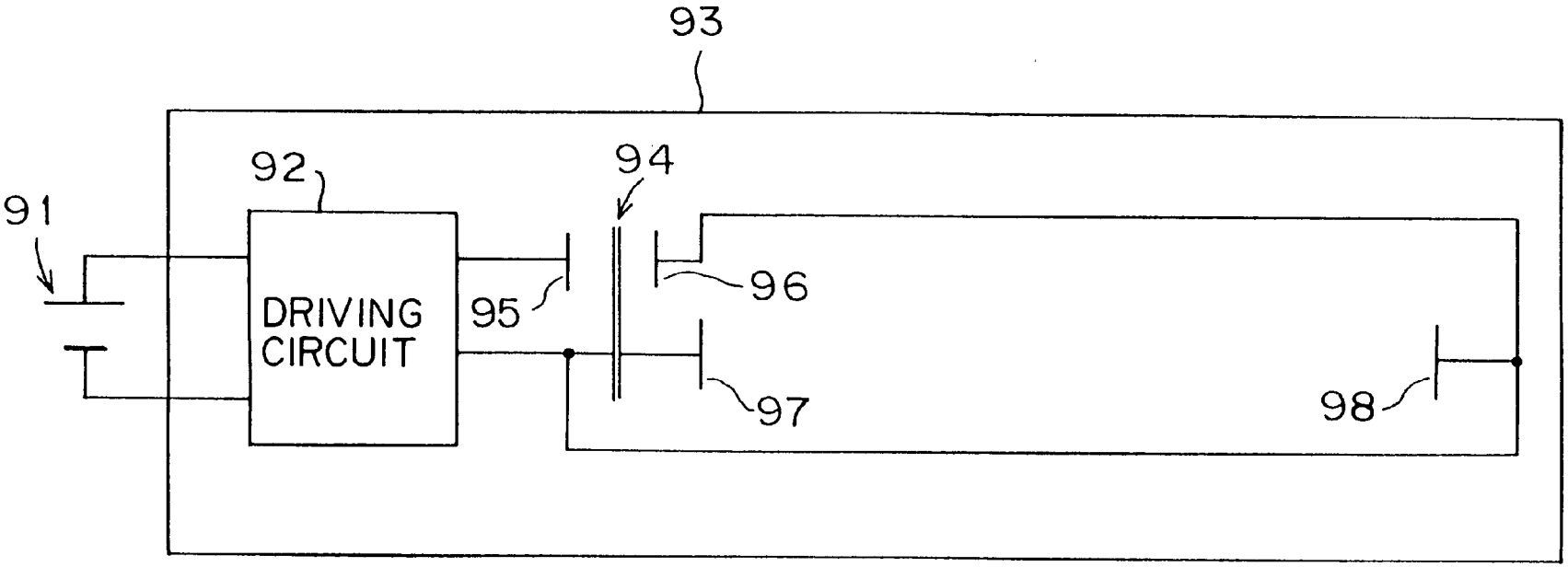
FIG. 9 is a schematic diagram showing an outline structure of a cold cathode tube according to a fifth embodiment of the present invention.

FIG. 9 is a schematic diagram showing an outline structure of a cold cathode tube according to a fifth embodiment of the present invention. In the fifth embodiment, a driving circuit that drives a piezoelectric transformer is enclosed in a cold cathode tube.

In FIG. 9, a driving circuit 92, a piezoelectric substrate 94, primary electrodes 95 and 96, a secondary electrode 97, and an anode 98 are enclosed in a cold cathode tube 93 along with a discharge gas. The primary electrodes 95 and 96 drive the piezoelectric substrate 94. The secondary electrode 97 outputs a voltage generated by the piezoelectric substrate 94. The secondary electrode 97 and the cathode 98 are held in such a manner that they are disposed opposite to each other with a predetermined distance. A DC power supply 91 is connected to the input side of the driving circuit 92. The primary electrode 95 is connected to one terminal on the output side of the driving circuit 92. The primary electrode 96, the cathode 98, and a ground point of the piezoelectric substrate 94 are connected to the other terminal on the output side of the driving circuit 92.

When the DC power supply 91 supplies a DC voltage of around 10V to the driving circuit 92, it converts the DC voltage to an AC voltage with a frequency ranging from 40 to 60 kHz and outputs the resultant AC voltage to the primary electrode 95. When the AC voltage is supplied between the primary electrode 95 and the primary electrode 96, the piezoelectric substrate 94 raises the AC voltage to around 1200V and outputs the resultant voltage to the secondary electrode 97.

The secondary electrode 97 forms an anode of the cold cathode tube 93. With the voltage raising effect of the piezoelectric transformer, a high AC voltage of around 1200V with a frequency ranging from 40 to 60 kHz is generated between the secondary electrode 97 and the cathode 98. Thus, the cold cathode tube 93 discharges electricity that causes mercury gas in the cold cathode tube 93 to irradiate ultraviolet rays. The ultraviolet rays activate a phosphor coated on an inner surface of the cold cathode tube 93 and cause the cold cathode tube 93 to emit light.

Since the driving circuit 92 that drives the piezoelectric transformer is disposed in the cold cathode tube 93 along with the piezoelectric transformer, only with a low DC voltage of around 10V supplied from the DC power supply 91 to the cold cathode tube 93, a high AC voltage of around 1200V with a frequency ranging from 40 to 60 kHz can be generated in the cold cathode tube 93. Thus, only with a low DC voltage supplied to the cold cathode tube 93, electricity can be discharged in the cold cathode tube 93. Consequently, when a voltage is supplied to the cold cathode tube 93, the power leakage out of the cold cathode tube 93 can be further suppressed. Thus, the power consumption of the cold cathode tube 93 can be further reduced.

Figure 10:
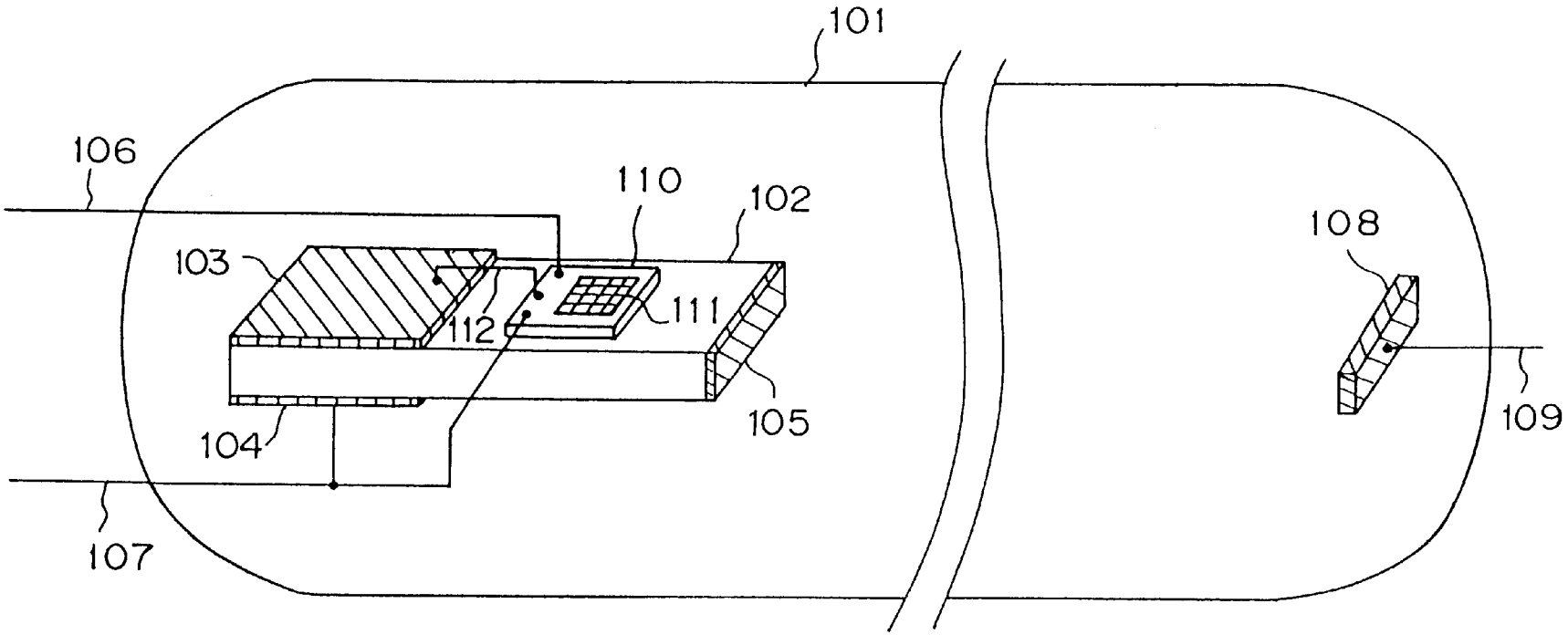
FIG. 10 is an isometric view showing an example of the structure of the cold cathode tube shown in FIG. 9.

FIG. 10 is an isometric of the owing an example of the structure of the cold cathode tube shown in FIG. 9.

In FIG. 10, a pair of primary electrodes 103 and 104 are formed on an upper surface and a lower surface of one portion of a rectangular plate-shaped piezoelectric substrate 102. A secondary electrode 105 is formed on an end surface of the other portion of the piezoelectric substrate 102. An IC chip 110 having a circuit pattern 111 is disposed on the piezoelectric substrate 102. A lead line 106 is connected to an input terminal of the IC chip 110. The primary electrode 103 is connected to an output terminal of the IC chip 110 with a wire line 112. A ground terminal of the IC chip 110 and the primary electrode 104 are connected to a lead line 107.

The lead lines 106 and 107 are be secured at one end of the cold cathode tube 101 so that the piezoelectric substrate 102 and the IC chip 110 are held in the cold cathode tube 101. The circuit pattern 111 is structured so that a DC voltage of around 10V supplied through the lead line 106 is converted into an AC voltage with a frequency ranging from 40 to 60 kHz and then supplied to the primary electrode 103.

A cathode 108 is held at the other end of the cold cathode tube 101 with a lead line 109. The secondary electrode 105 of the piezoelectric substrate 102 is disposed opposite to the cathode 108. Thus, the secondary electrode 105 of the piezoelectric substrate 102 forms the anode of the cold cathode tube 101.

When a DC voltage of around 10V is supplied to the lead line 106, the IC chip 110 converts the DC voltage into an AC voltage with a frequency ranging from 40 to 60 kHz and outputs the resultant AC voltage to the primary electrode 103. When the AC voltage is supplied between the primary electrode 103 and the primary electrode 104, the piezoelectric substrate 102 raises the AC voltage to around 1200V and outputs the resultant AC voltage to the secondary electrode 105.

Thus, a high AC voltage of around 1200V with a frequency ranging from 40 to 60 kHz is generated between the secondary electrode 105 and the cathode 108. Consequently, the cold cathode tube 101 discharges electricity that causes mercury gas in the cold cathode tube 101 to irradiate ultraviolet rays. The ultraviolet rays activate a phosphor coated on an inner surface of the cold cathode tube 101 and cause the cold cathode tube 101 to emit light.

In this case, only a DC voltage of around 10V is supplied to the lead line 106. Thus, the power leakage due to the stray capacitance of the lead line 106 is almost non-existent. In addition, since the IC chip 110 is disposed on the piezoelectric substrate 102, the IC chip 110 can be disposed close to the primary electrode 103. Thus, the length of a wiring line of the AC voltage supplied from the IC chip 110 to the primary electrode 103 can be decreased. Thereby, the power leakage due to the stray capacitance of a wiring line 112 connected between the IC chip 110 and the primary electrode 103 can be almost removed.

Alternatively, with a protection film such as a Si3N4 (silicon nitride) film, a PSG (phosphor glass) film, or a polyamide glass film, the circuit pattern 111 on the IC chip 110 can be protected. In addition, the IC chip 110 may be molded with an epoxy resin or a silicon resin. Alternatively, the circuit pattern 111 may be directly formed on the piezoelectric substrate 102 by an SOI (Silicon On Insulator)

process or the like. As another alternative method, a function for monitoring an output of a piezoelectric transformer may be integrated with the IC chip 110 so as to vary the operating condition of the piezoelectric transformer corresponding to the variation of the resonant characteristics in the operating state of the piezoelectric transformer.

Figure 11:
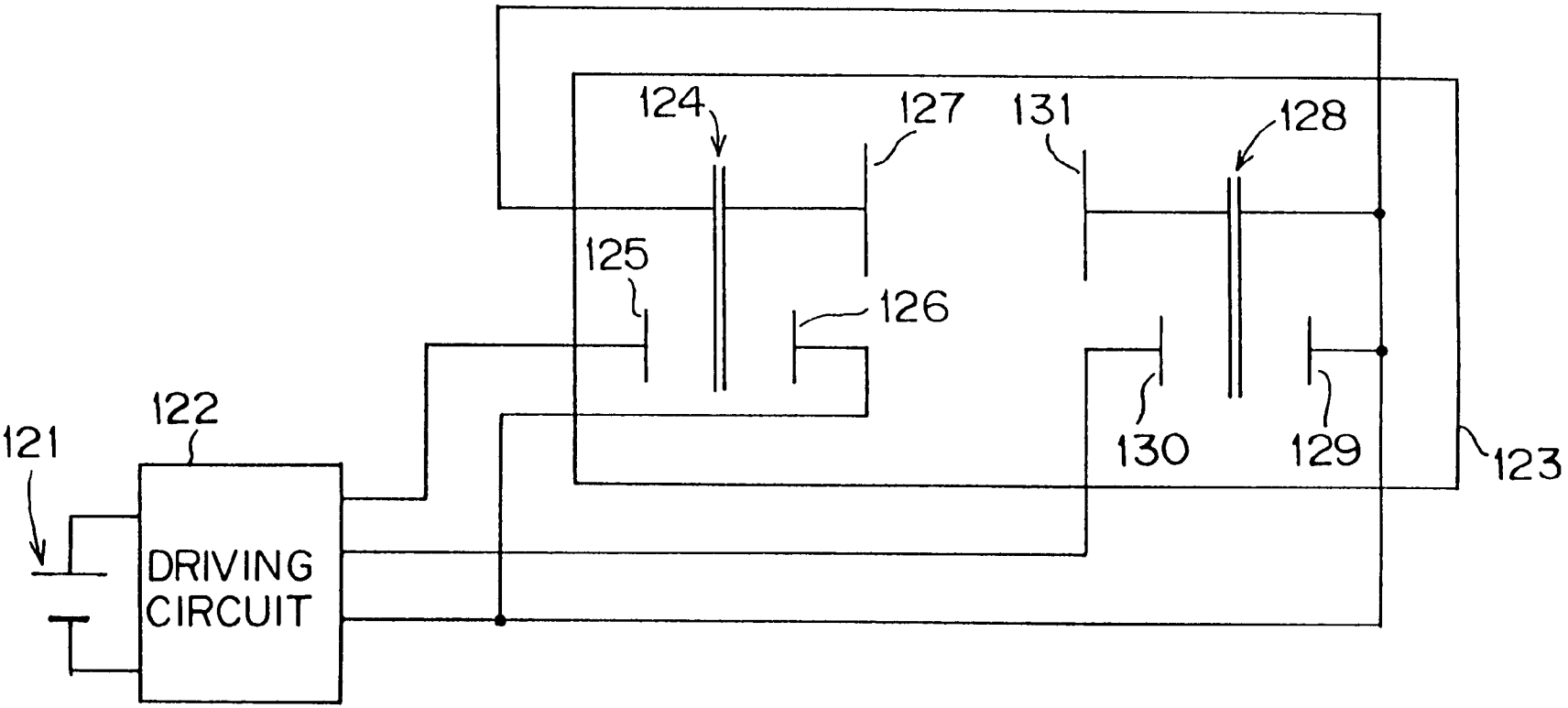
FIG. 11 is a schematic diagram showing an outline structure of a discharging apparatus according to a sixth embodiment of the present invention.

FIG. 11 is a schematic diagram showing an outline structure of a discharging apparatus according to a sixth embodiment of the present invention.

In the sixth embodiment, piezoelectric transformers are disposed for both an anode and a cathode of a cold cathode tube. The piezoelectric transformer for the anode and the piezoelectric transformer for the cathode are driven with AC voltages whose phases are opposite to each other.

In FIG. 11, piezoelectric substrates 124 and 128, primary electrodes 125 and 126, a secondary electrode 127, primary electrodes 129 and 130, a secondary electrode 131, and a discharge gas are enclosed in a cold cathode tube 123. The primary electrodes 125 and 126 drive the piezoelectric substrate 124. The secondary electrode 127 outputs a voltage generated by the piezoelectric substrate 124. The primary electrodes 129 and 130 drive the piezoelectric substrate 128. The secondary electrode 131 outputs a voltage generated by the piezoelectric substrate 128. The secondary electrode 127 and the secondary electrode 131 are disposed opposite to each other with a predetermined distance.

A DC power supply 121 is connected on the input side of a driving circuit 122. The primary electrode 125 is connected to a forward output terminal of the driving circuit 122. The primary electrode 130 is connected to a reverse output terminal of the driving circuit 122. The primary electrodes 126 and 129 and ground points of the piezoelectric substrates 124 and 128 are connected to a ground terminal of the driving circuit 122.

When a DC power supply 121 supplies a DC voltage of around 10V to the driving circuit 122, the driving circuit 122 converts the DC voltage into an AC voltage with a frequency ranging from 40 to 60 kHz and generates a first AC voltage and a second AC voltage with a frequency ranging from 40 to 60 kHz, the phase of the first AC voltage being opposite to the phase of the second AC voltage. The first AC voltage is supplied to the primary electrode 125. The second AC voltage is supplied to the primary electrode 130.

When the first AC voltage is supplied between the primary electrode 125 and the primary electrode 126, the piezoelectric substrate 124 raises the first AC voltage to around 1200V and outputs the raised voltage to the secondary electrode 127. When the second AC voltage is supplied between the primary electrode 129 and the primary electrode 130, the piezoelectric substrate 128 raises the second AC voltage to around 1200V and outputs the raised voltage to the secondary electrode 131.

The secondary electrode 127 forms an anode of the cold cathode tube 123. The secondary electrode 131 forms a cathode of the cold cathode tube 123. When the piezoelectric substrate 124 and the piezoelectric substrate 128 are driven with the first AC voltage and the second AC voltage whose phases are opposite to each other, a high AC voltage of around 2400V is generated between the secondary electrode 127 and the secondary electrode 131. Thus, the cold cathode tube 123 discharges electricity that causes mercury gas in the cold cathode tube 123 to irradiate ultraviolet rays. The ultraviolet rays activate a phosphor coated on an inner surface of the cold cathode tube 123 and cause the cold cathode tube 123 to emit light.

With the piezoelectric transformers disposed at the anode and the cathode of the cold cathode tube 123, the power leakage due to the stray capacitance of wiring lines can be suppressed. In addition, the potential between the anode and the cathode of the cold cathode tube 123 can be further increased. Thus, the cold cathode tube 123 can more effectively emit light.

Figure 12:
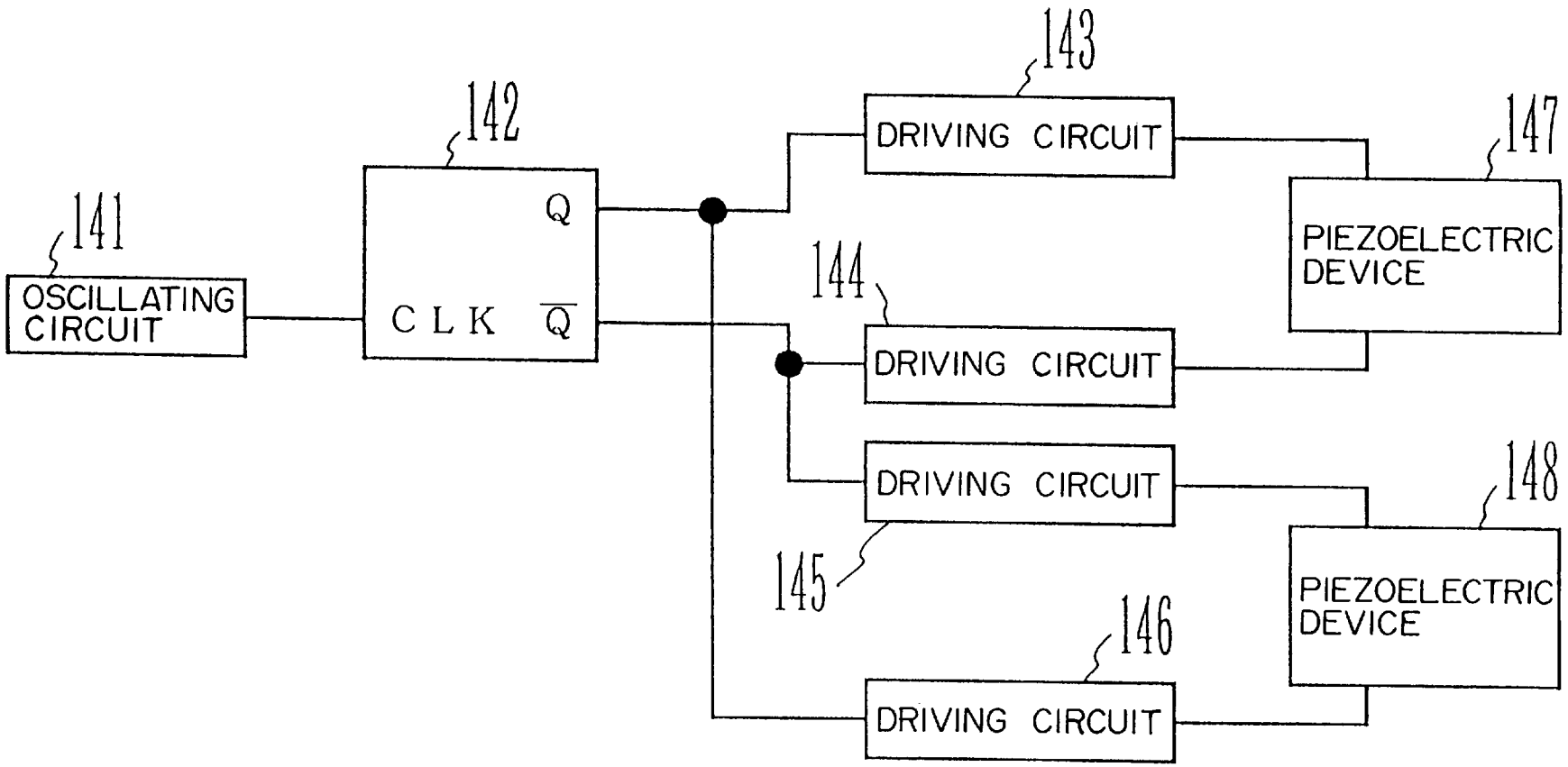
FIG. 12 is a block diagram showing an example of the structure of a driving circuit shown in FIG. 11.

FIG. 12 is a block diagram showing an example of the structure of the driving circuit shown in FIG. 11.

In FIG. 12, an output terminal of an oscillating circuit 141 is connected to a clock terminal of a flip-flop 142. A forward output terminal of the flip-flop 142 is connected to driving circuits 143 and 146. A reverse output terminal of the flip-flop 142 is connected to driving circuits 144 and 145. The driving circuits 143 and 144 drive a piezoelectric device 147. The driving circuits 145 and 146 drive a piezoelectric device 148.

Thus, the piezoelectric devices 147 and 148 are driven with voltages whose phases are opposite to each other. A voltage generated between the piezoelectric device 147 and the piezoelectric device 148 is twice the voltage generated by either the piezoelectric device 147 or 148.

Figure 13:
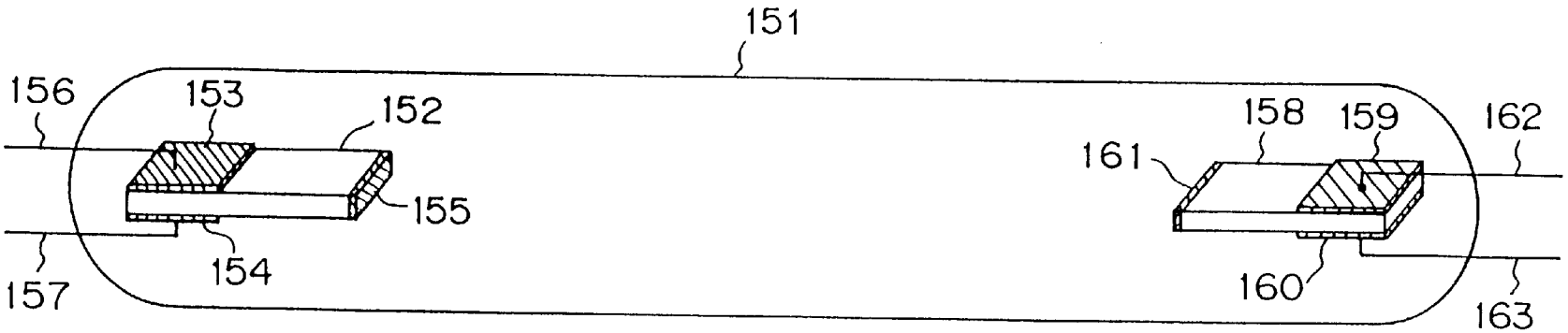
FIG. 13 is an isometric view showing an example of the structure of a discharging tube shown in FIG. 11.

FIG. 13 is an isometric view showing an example of the structure of the discharging tube shown in FIG. 11.

In FIG. 13, a pair of primary electrodes 153 and 154 are formed on an upper surface and a lower surface of one portion of a rectangular plate-shaped piezoelectric substrate 152. A secondary electrode 155 is formed on an end surface of the other portion of the piezoelectric substrate 152. A lead line 156 is disposed at the primary electrode 153. A lead line 157 is disposed at the primary electrode 15 4. The lead lines 156 and 157 are secured at one end of the cold cathode tube 151 so as to hold the piezoelectric substrate 152 in the cold cathode tube 151.

A pair of primary electrodes 159 and 160 are formed on an upper surface and a lower surface of one portion of a rectangular plate-shaped piezoelectric substrate 158. A secondary electrode 161 is formed on an end surface of the other portion of the piezoelectric substrate 158. A lead line 162 is disposed at the primary electrode 159. A lead line 163 is disposed at the primary electrode 160. The lead lines 162 and 163 are secured at the other end of the cold cathode tube 151 so as to hold the piezoelectric substrate 158 in the cold cathode tube 151.

The secondary electrode 155 of the piezoelectric substrate 152 and the secondary electrode 161 of the piezoelectric substrate 158 are disposed opposite to each other. The secondary electrode 155 of the piezoelectric substrate 152 forms an anode of the cold cathode tube 151. The secondary electrode 161 of the piezoelectric substrate 158 forms a cathode of the cold cathode tube 151.

Thus, electricity is discharged between the secondary electrode 155 of the piezoelectric substrate 152 and the secondary electrode 161 of the piezoelectric substrate 158 in the cold cathode tube 151. Consequently, since the anode and the cathode of the cold cathode tube 151 are omitted, the size and weight of the cold cathode tube 151 can be reduced. In addition, since the piezoelectric substrate 152 and the piezoelectric substrate 158 are driven with voltages whose phases are opposite to each other, the voltage generated between the secondary electrode 155 and the secondary electrode 161 is twice the voltage generated by one piezoelectric transformer.

When the cathode of the cold cathode tube 151 is formed by the secondary electrode 161 of the piezoelectric substrate 158, the secondary electrode 161 may be composed of tungsten or thorium. Alternatively, it may be coated with an electron emission material composed of an oxide of Ba, Sr, Ca, Zr, or the like.

Figure 14:
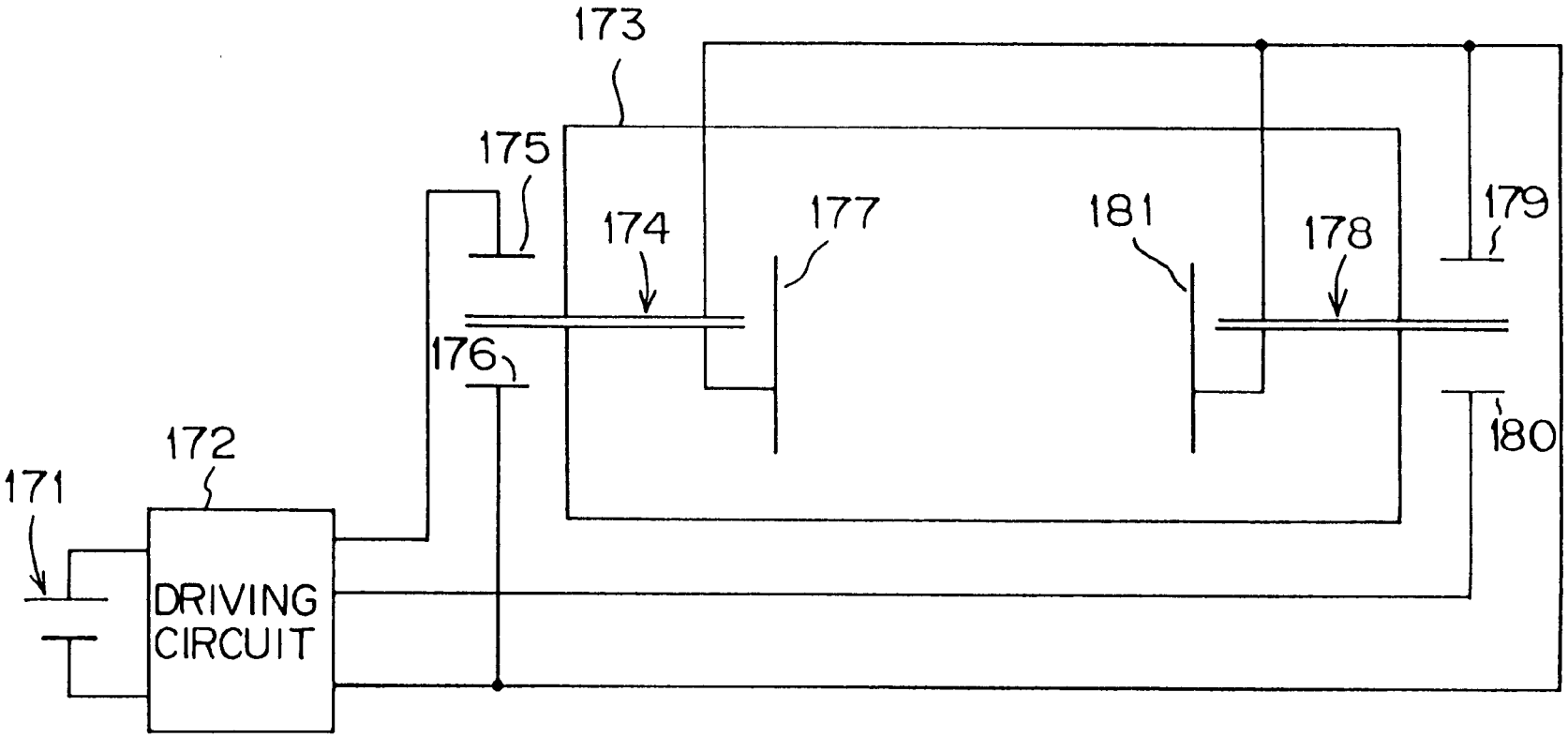
FIG. 14 is a schematic diagram showing an outline structure of a discharging apparatus according to a seventh embodiment of the present invention.

FIG. 14 is a schematic diagram showing an outline structure of a discharging apparatus according to a seventh embodiment of the present invention. In the seventh embodiment, piezoelectric transformers are disposed for an anode and a cathode of a cold cathode tube. The piezoelectric transformers are directly held at nodes of the vibrations thereof by the cold cathode tube. The secondary electrodes of the piezoelectric transformers are disposed in the cold cathode tube. The primary electrodes of the piezoelectric transformers are disposed outside the cold cathode tube.

In FIG. 14, primary electrodes 175 and 176 and a secondary electrode 177 are disposed on a piezoelectric substrate 174. The primary electrodes 175 and 176 drive the piezoelectric substrate 174. The secondary electrode 177 outputs a voltage generated by the piezoelectric substrate 174. Primary electrodes 179 and 180 and a secondary electrode 181 are disposed on a piezoelectric substrate 178. The primary electrodes 179 and 180 drive the piezoelectric substrate 178. The secondary electrode 181 outputs a voltage generated by the piezoelectric substrate 178. The secondary electrode 177 of the piezoelectric substrate 174, the secondary electrode 181 of the piezoelectric substrate 178, and a discharge gas are enclosed in the cold cathode tube 173.

The cold cathode tube 173 holds the piezoelectric substrate 174 at a node of the vibration thereof. In addition, the cold cathode tube 173 holds the piezoelectric substrate 178 at a node of the vibration thereof. In the cold cathode tube 173, the secondary electrode 177 and the secondary electrode 181 are disposed opposite to each other with a predetermined distance. A DC power supply 171 is connected to the input side of the driving circuit 172. The primary electrode 175 is connected to a forward output terminal of the driving circuit 172. The primary electrode 180 is connected to a reverse output terminal of the driving circuit 172. The primary electrodes 176 and 179 and ground points of the piezoelectric substrates 174 and 178 are connected to a ground terminal of the driving circuit 172.

When the DC power supply 171 supplies a DC voltage of around 10V to the driving circuit 172, the driving circuit 172 converts the DC voltage into an AC voltage with a frequency ranging from 40 to 60 kHz and generates a first AC voltage and a second AC voltage with a frequency ranging from 40 to 60 kHz, the phase of the first AC voltage and the phase of the second AC voltage being opposite to each other. The first AC voltage is supplied to the primary electrode 175. The secondary AC voltage is supplied to the primary electrode 180.

When the first AC voltage is supplied between the primary electrode 175 and the primary electrode 176, the piezoelectric substrate 174 raises the first AC voltage to around 1200V and outputs the resultant voltage to the secondary electrode 177. When the second AC voltage is supplied between the primary electrode 179 and the primary electrode 180, the piezoelectric substrate 178 raises the secondary AC voltage to around 1200V and outputs the resultant voltage to the secondary electrode 181. In this case, since the piezoelectric substrates 174 and 178 are held at nodes of the vibrations thereof, the voltages can be effectively raised.

The secondary electrode 177 forms an anode of the cold cathode tube 173. The secondary electrode 181 forms a cathode of the cold cathode tube 173. When the piezoelectric substrate 174 and the piezoelectric substrate 178 are driven with the first AC voltage and the second AC voltage whose phases are opposite to each other, respectively, a high AC voltage of around 2400V is generated between the secondary electrode 177 and the secondary electrode 181. Thus, the cold cathode tube 173 discharges electricity that causes mercury gas in the cold cathode tube 173 to irradiate ultraviolet rays. The ultraviolet rays activate a phosphor coated on an inner surface of the cold cathode tube 173 and cause the cold cathode tube 173 to emit light.

Thus, since the piezoelectric transformers are disposed at the anode and the cathode of the cold cathode tube 173 and the piezoelectric transformers are held at nodes of the vibrations thereof, while the voltage rise ratios of the piezoelectric transformers are prevented from decreasing, the potential between the anode and the cathode of the cold cathode tube 173 can be further increased. Consequently, the cold cathode tube 173 can more effectively emit light.

When only the secondary electrodes 177 and 181 of the piezoelectric transformers are disposed in the cold cathode tube 173 and the primary electrodes 175, 176, 179, and 180 are disposed outside the cold cathode tube 173, the size of the cold cathode tube 173 can be reduced. In addition, since the driving circuit 172 is disposed outside the cold cathode tube 173 and on the piezoelectric substrates 174 and 178, the driving circuit 172 can be prevented from being affected by the electricity discharged. In addition, the length of wiring lines connected between the driving circuit 172 and the primary electrodes 175 and 180 can be decreased.

Figure 15:
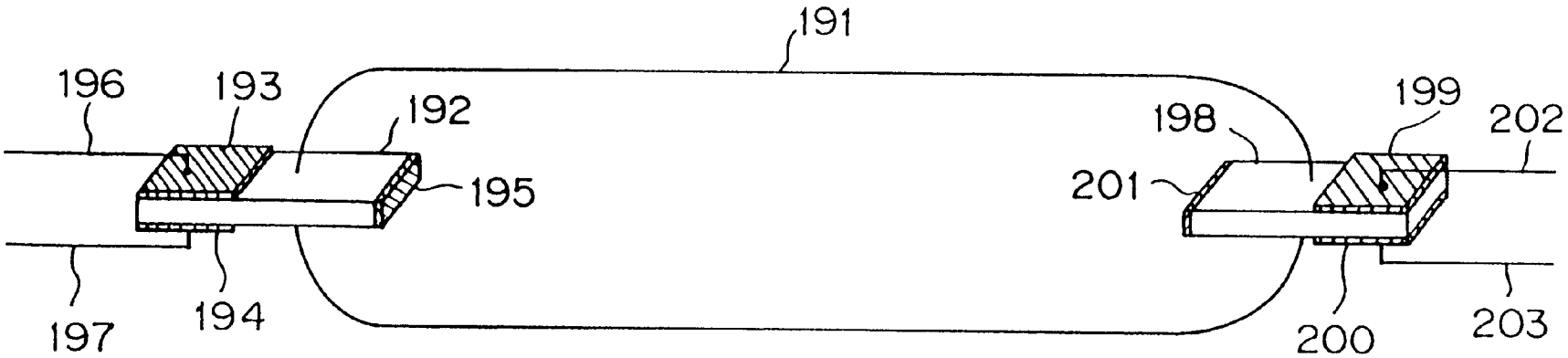
FIG. 15 is an isometric view showing an outline structure of a cold cathode tube shown in FIG. 14.

FIG. 15 is an isometric view showing an outline structure of the cold cathode tube shown in FIG. 14.

In FIG. 15, a pair of primary electrodes 193 and 194 are formed on an upper surface and a lower surface of one portion of a rectangular plate-shaped piezoelectric substrate 192. A secondary electrode 195 is formed on an end surface of the other portion of the piezoelectric substrate 192. A lead line 196 is disposed at the primary electrode 193. A lead line 197 is disposed at the primary electrode 194. A node portion of the vibration of the piezoelectric substrate 192 is secured at one end of a cold cathode tube 191. Thus, the piezoelectric substrate 192 is held in such a manner that the secondary electrode 195 is disposed inside the cold cathode tube 191 and the primary electrodes 193 and 194 are disposed outside the cold cathode tube 191.

A pair of primary electrodes 199 and 200 are disposed on an upper surface and a lower surface of one portion of a rectangular plate-shaped piezoelectric substrate 198. A secondary electrode 201 is formed on an end surface of the other portion of the piezoelectric substrate 198. A lead line 202 is disposed at the primary electrode 199. A lead line 203 is disposed at the primary electrode 200. A node portion of the vibration of the piezoelectric substrate 198 is secured at the other end of the cold cathode tube 191. Thus, the piezoelectric substrate 198 can be held in such a manner that the secondary electrode 201 is disposed inside the cold cathode tube 191 and the primary electrodes 199 and 200 are disposed outside the cold cathode tube 191.

In the cold cathode tube 191, the secondary electrode 195 of the piezoelectric substrate 192 and the secondary electrode 201 of the piezoelectric substrate 198 are disposed opposite to each other. The secondary electrode 195 of the piezoelectric substrate 192 forms an anode of the cold cathode tube 191. The secondary electrode 201 of the piezoelectric substrate 198 forms a cathode of the cold cathode tube 191.

Thus, electricity is discharged between the secondary electrode 195 of the piezoelectric substrate 192 and the secondary electrode 201 of the piezoelectric substrate 198 in the cold cathode tube 191. Consequently, the anode and the cathode of the cold cathode tube 191 can be omitted. Thus, the size and weight of the cold cathode tube 191 can be reduced. Since the piezoelectric substrate 192 and the piezoelectric substrate 198 are driven with voltages whose phases are opposite to each other, the voltage generated between the secondary electrode 195 and the secondary electrode 201 is twice the voltage generated by one piezoelectric transformer. In addition, since the piezoelectric substrate 192 and the piezoelectric substrate 198 are held at nodes of the vibrations thereof, the voltage rise ratios can be prevented from decreasing. Moreover, since the primary electrodes 193, 194, 199, and 200 are disposed outside the cold cathode tube 191, the size of the cold cathode tube 191 can be further reduced.

Figure 16:
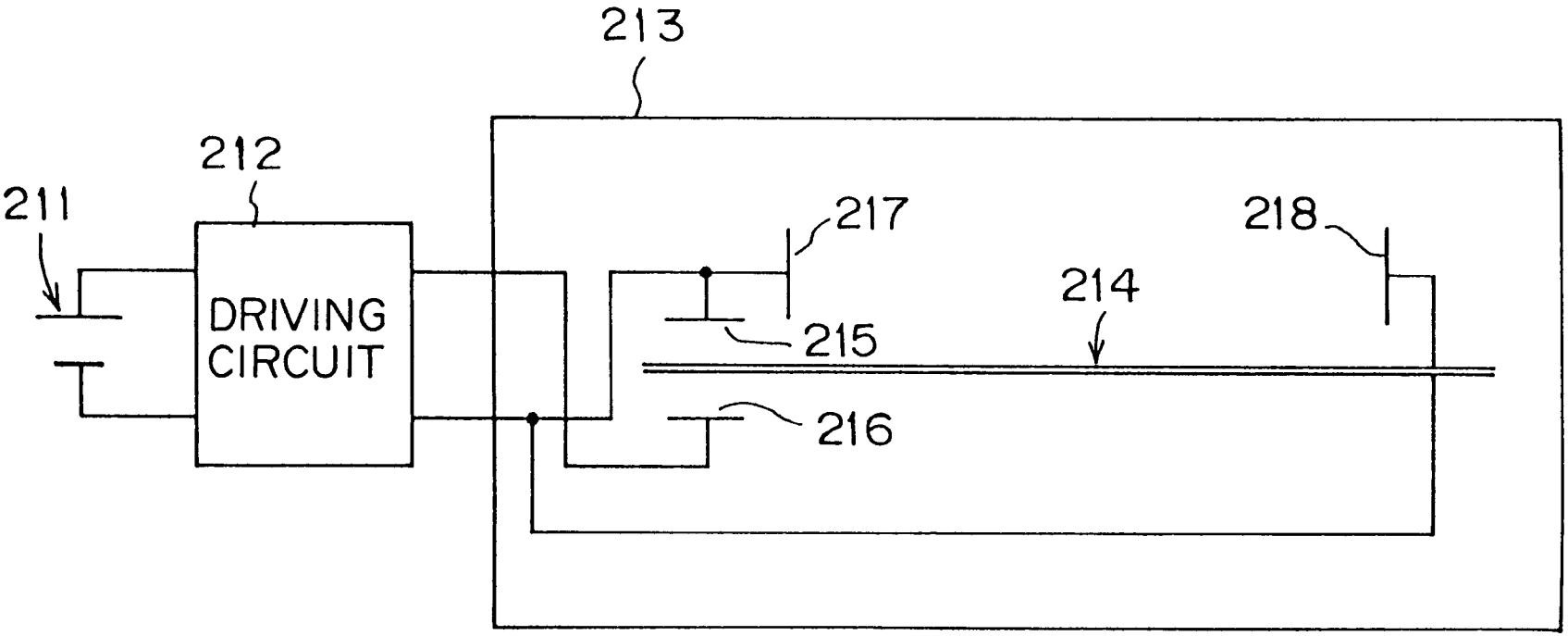
FIG. 16 is a schematic diagram showing an outline structure of a discharging apparatus according to an eighth embodiment of the present invention.

FIG. 16 is a schematic diagram showing an outline structure of a discharging apparatus according to an eighth embodiment of the present invention.

In the eighth embodiment, the length of a piezoelectric substrate is substantially the same as the length of a discharging tube.

In FIG. 16, a piezoelectric substrate 214, primary electrodes 215 and 216, a cathode 217, and a secondary electrode 218 are enclosed in a cold cathode tube 213 along with a discharge gas. The primary electrodes 215 and 216 drive the piezoelectric substrate 214. The secondary electrode 218 outputs a voltage generated by the piezoelectric substrate 214. The length of the piezoelectric substrate 214 is substantially the same as the length of the cold cathode tube 213. In addition, the cathode 217 and the secondary electrode 218 are disposed opposite to each other with a predetermined distance. A DC power supply 211 is connected to the input side of a driving circuit 212. The primary electrode 216 is connected to one terminal on the output side of the driving circuit 212. The primary electrode 215, the cathode 217, and a ground point of the piezoelectric substrate 214 are connected to the other terminal on the output side of the driving circuit 212.

When the DC power supply 211 supplies a DC voltage of around 10V to the driving circuit 212, it converts the DC voltage into an AC voltage with a frequency ranging from 40 to 60 kHz and outputs the resultant voltage to the primary electrode 216. When the AC voltage is supplied between the primary electrode 215 and the primary electrode 216, the piezoelectric substrate 214 raise the AC voltage to around 1200V and outputs the resultant voltage to the secondary electrode 218.

The secondary electrode 218 forms an anode of the cold cathode tube 213. With the voltage raising effect of the piezoelectric transformer, a high AC voltage of around 1200V with a frequency ranging from 40 to 60 kHz is generated between the cathode 217 and the secondary electrode 218. Thus, the cold cathode tube 213 discharges electricity that causes mercury gas in the cold cathode tube 213 to irradiate ultraviolet rays. The ultraviolet rays activate a phosphor coated on an inner surface of the cold cathode tube 213 and cause the cold cathode tube 213 to emit light.

Consequently, when the length of the piezoelectric substrate 214 is substantially the same as the length of the cold cathode tube 213, the high voltage wiring lines can be shortened. Thus, the power leakage out of the cold cathode tube due to the stray capacitance of the wiring lines or the like can be suppressed. Consequently, the cold cathode tube 213 can be effectively operated.

Figure 17:
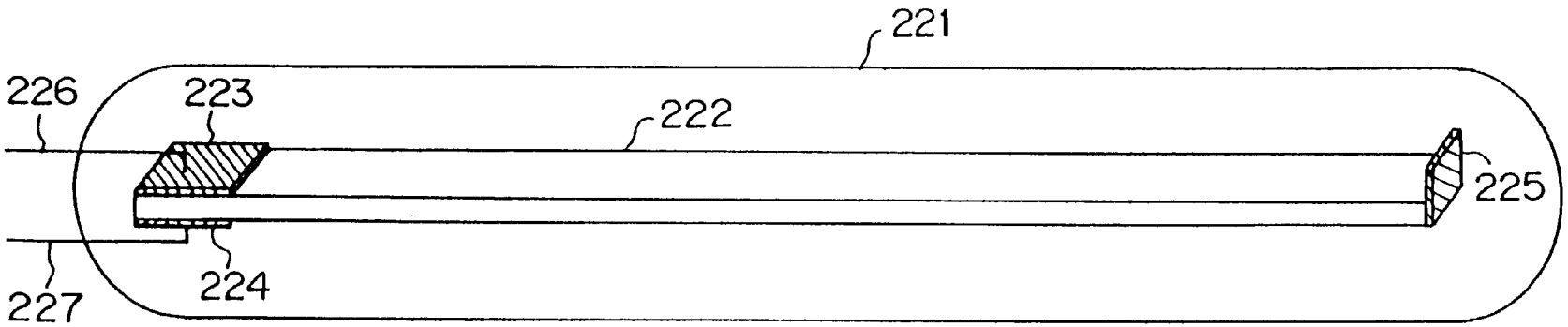
FIG. 17 is an isometric view showing an outline structure of a cold cathode tube shown in FIG. 16.

FIG. 17 is an isometric view showing an outline structure of the cold cathode tube shown in FIG. 16.

In FIG. 17, a pair of primary electrodes 223 and 224 are formed on an upper surface and a lower surface of one end of a rectangular plate-shaped piezoelectric substrate 222. A secondary electrode 225 is formed on an end surface of the other end of the piezoelectric substrate 222. The secondary electrode 225 protrudes above the end surface of the piezoelectric substrate 222. Thus, the primary electrode 223 and the secondary electrode 225 are disposed opposite to each other on the piezoelectric substrate 222. A lead line 226 is disposed at the primary electrode 223. A lead line 227 is disposed at the primary electrode 224. The lead lines 226 and 227 are secured at one end of the cold cathode tube 221 so as to hold the piezoelectric substrate 222 in the cold cathode tube 221.

The primary electrode 223 forms a cathode of the cold cathode tube 221. The secondary electrode 225 forms an anode of the cold cathode tube 221. Thus, when an AC voltage is supplied between the primary electrodes 223 and 224 through the lead lines 226 and 227, with the voltage raising effect of the piezoelectric substrate 222, a high AC voltage is generated at the secondary electrode 225. Consequently, electricity is discharged between the primary electrode 223 and the secondary electrode 225.

Thus, when the length of the piezoelectric substrate 222 is substantially the same as the length of the cold cathode tube 221, the anode and the cathode of the cold cathode tube 221 can be omitted. Consequently, the size and weight of the cold cathode tube 221 can be reduced. In addition, since high voltage wiring lines can be omitted, the power leakage out of the cold cathode tube due to the stray capacitance of the wiring lines or the like can be suppressed. Thus, the cold cathode tube 221 can be effectively operated.

Figure 18:
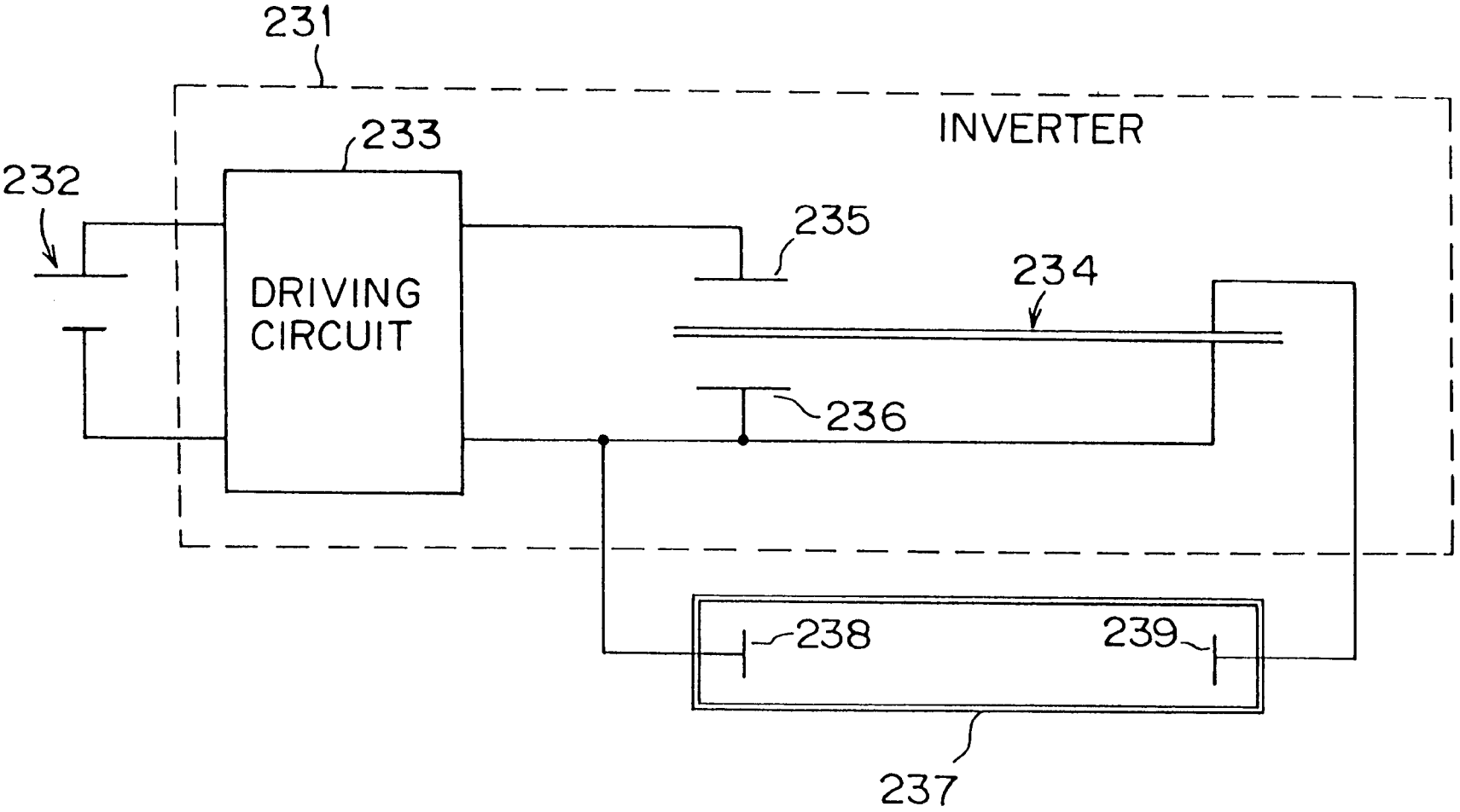
FIG. 18 is a schematic diagram showing an outline structure of a discharging apparatus according to a ninth embodiment of the present invention.

FIG. 18 is a schematic diagram showing an outlined structure of a discharging apparatus according to a ninth embodiment of the present invention.

In the ninth embodiment, the length of a piezoelectric transformer is substantially the same as the length of a cold cathode tube. The piezoelectric transformer is used for an inverter that drives the cold cathode tube.

In FIG. 18, an inverter 231 comprises a driving circuit 233 and a piezoelectric transformer. A piezoelectric substrate 234 that composes the piezoelectric transformer comprises primary electrodes 235 and 236 and a secondary electrode. The primary electrodes 235 and 236 drive the piezoelectric substrate 234. The secondary electrode outputs a voltage generated on the piezoelectric substrate 234. The length of the piezoelectric substrate 234 is substantially the same as the length of the cold cathode tube 237. The primary electrode 236 of the piezoelectric substrate 234 is connected to a cathode 238 of the cold cathode tube 237. The secondary electrode is connected to an anode 239 of the cold cathode tube 237.

A DC power supply 232 is connected to the input side of the driving circuit 233. The primary electrode 235 is connected to one terminal on the output side of the driving circuit 233. The primary electrode 236, the cathode 238, and a ground point of the piezoelectric substrate 234 are connected to the other terminal on the output side of the driving circuit 233. Since the length of the piezoelectric substrate 234 is substantially the same as the length of the cold cathode tube 237, the length of a wiring line connected from the secondary electrode of the piezoelectric substrate 234 to the anode 239 of the cold cathode tube 237 can be decreased.

When the DC power supply 232 supplies a DC voltage of around 10V to the driving circuit 233, the driving circuit 233 converts the DC voltage into an AC voltage with a frequency ranging from 40 to 60 kHz and outputs the resultant AC voltage to the primary electrode 235. When the AC voltage is supplied between the primary electrode 235 and the primary electrode 236, the piezoelectric substrate 234 raises the AC voltage to around 1200V and outputs the resultant AC voltage to the secondary electrode.

The voltage generated at the secondary electrode is supplied to the anode 239 of the cold cathode tube 237. Thus, a high AC voltage of around 1200V with a frequency ranging from 40 to 60 kHz is generated between the cathode 238 and the anode 239 of the cold cathode tube 237. Consequently, the cold cathode tube 237 discharges electricity that causes mercury gas in the cold cathode tube 237 to irradiate ultraviolet rays. The ultraviolet rays activate a phosphor coated on an inner surface of the cold cathode tube 237 and cause the cold cathode tube 237 to emit light.

Since the length of the piezoelectric substrate 234 disposed in the inverter 231 is substantially the same as the length of the cold cathode tube 237, the length of a wiring line necessary for supplying a high AC voltage of around 1200V with a frequency ranging from 40 to 60 kHz to the cold cathode tube 237 can be decreased. Thus, the power leakage out of the cold cathode tube due to the stray capacitance of the wiring line or the like can be suppressed. Consequently, the cold cathode tube 237 can be effectively operated.

Figure 19:
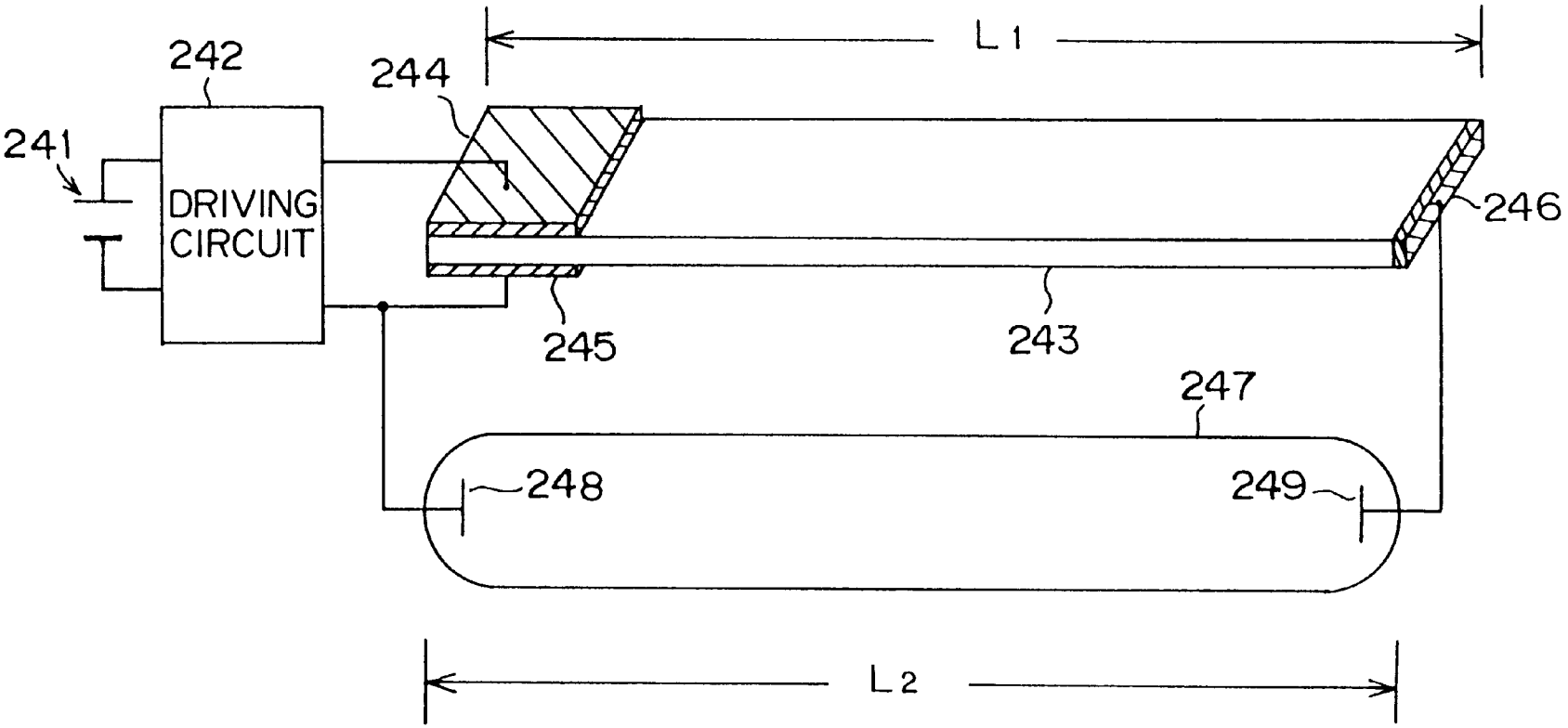
FIG. 19 is an isometric view showing an outline structure of a discharging apparatus shown in FIG. 18.

FIG. 19 is an isometric view showing an outline structure of the discharging apparatus shown in FIG. 18.

In FIG. 19, a pair of primary electrodes 244 and 245 are formed on an upper surface and a lower surface at one end of a rectangular plate-shaped piezoelectric substrate 243. A secondary electrode 246 is formed on the surface of the other end of the piezoelectric substrate 243. The length L1 of the piezoelectric substrate 243 is substantially the same as the length L2 of the cold cathode tube 247. The primary electrode 245 of the piezoelectric substrate 243 is connected to a cathode 248 of the cold cathode tube 247. The secondary electrode 246 is connected to an anode 249 of the cold cathode tube 247. A DC power supply 241 is connected on the input side of the driving circuit 242. The primary electrode 244 is connected to one terminal on the output side of the driving circuit 242. The primary electrode 245 and the cathode 248 are connected to the other terminal on the output side of the driving circuit 242.

When a DC voltage of around 10V is supplied to the driving circuit 242, the driving circuit 242 converts the DC voltage into an AC voltage with a frequency ranging from 40 to 60 kHz and outputs the resultant voltage to the primary electrode 244. When the AC voltage is supplied between the primary electrode 244 and the primary electrode 245, the piezoelectric substrate 243 raises the AC voltage to around 1200V and outputs the resultant voltage to the secondary electrode 246.

The voltage generated at the secondary electrode 246 is supplied to the anode 249 of the cold cathode tube 247. Thus, a high AC voltage of around 1200V with a frequency ranging from 40 to 60 kHz is generated between the cathode 248 and the anode 249 of the cold cathode tube 247. Consequently, electricity is discharged in the cold cathode tube 247.

Since the length L1 of the piezoelectric substrate 243 is substantially the same as the length L2 of the cold cathode tube 247, the length of a wiring line connected between the secondary electrode 246 and the anode 249 can be decreased. Thus, the power leakage out of the cold cathode tube 247 due to the stray capacitance of the wiring line or the like can be suppressed. Thus, the cold cathode tube 247 can be effectively operated.

Figure 20:
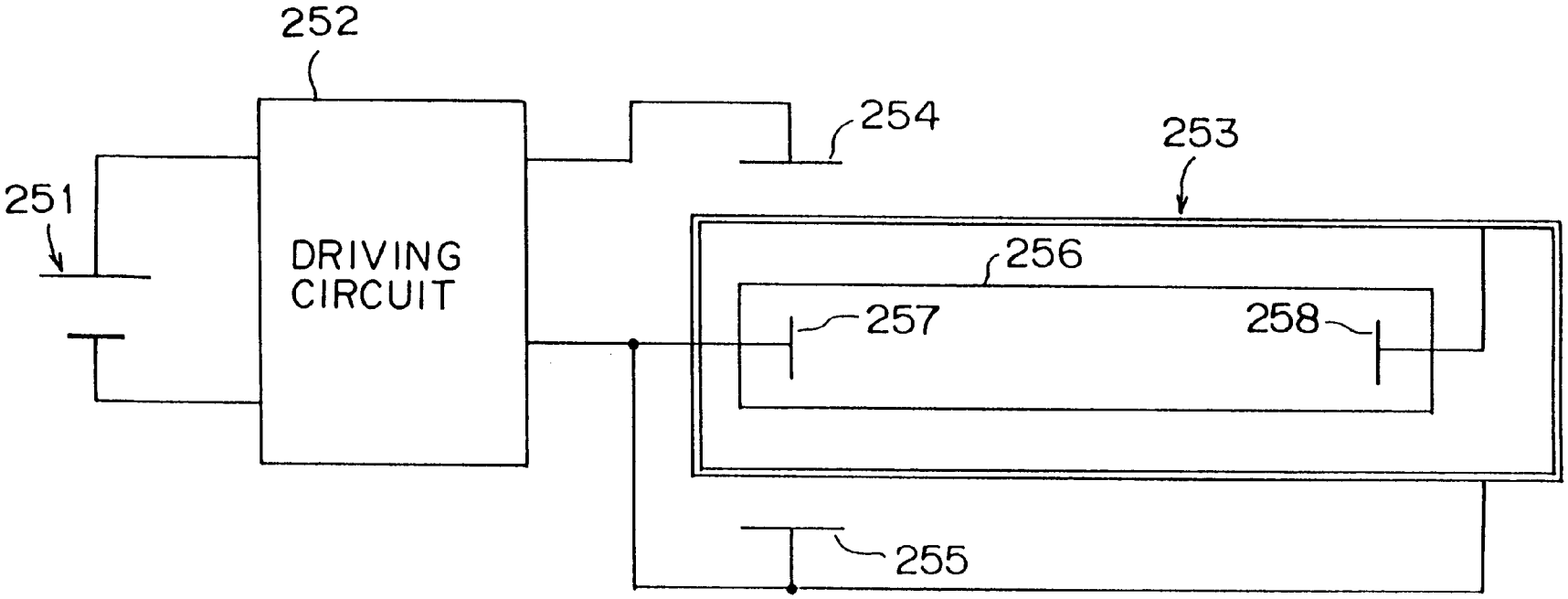
FIG. 20 is a schematic diagram showing an outline structure of a discharging apparatus according to a tenth embodiment of the present invention.

FIG. 20 is a schematic diagram showing an outline structure of a discharging apparatus according to a tenth embodiment of the present invention.

In the tenth embodiment, the section perpendicular to the direction of the length of a piezoelectric transformer is formed in a U-letter shape. The piezoelectric transformer is also used as an inverter that drives a cold cathode tube. The piezoelectric transformer is also used as a lamp holder of the cold cathode tube.

In FIG. 20, a piezoelectric substrate 253 has primary electrodes 254 and 255 and a secondary electrode. The primary electrodes 254 and 255 drive the piezoelectric substrate 253. The secondary electrode outputs a voltage generated by the piezoelectric substrate 253. The length of the piezoelectric substrate 253 is substantially the same as the length of a cold cathode tube 256. In addition, the section perpendicular to the direction of the length of the piezoelectric transformer is formed in a U-letter shape. Thus, the cold cathode tube 256 can be disposed in the piezoelectric substrate 253. The primary electrode 255 of the piezoelectric substrate 253 is connected to a cathode 257 of the cold cathode tube 256. The secondary electrode is connected to an anode 258 of the cold cathode tube 256. A DC power supply 251 is connected on the input side of a driving circuit 252. The primary electrode 254 is connected to one terminal on the output side of the driving circuit 252. The primary electrode 255, the cathode 257, and a ground point of the piezoelectric substrate 253 are connected to the other terminal on the output side of the driving circuit 252. Since the length of the piezoelectric substrate 253 is substantially the same as the length of the cold cathode tube 256, the length of a wiring line connected from the secondary electrode of the piezoelectric substrate 253 to the anode 258 of the cold cathode tube 256 can be decreased. In addition, since the section of the piezoelectric substrate 253 is formed in a U-letter shape, the piezoelectric substrate 253 can be used for a lamp holder.

When the DC power supply 251 supplies a DC voltage of around 10V to the driving circuit 252, the driving circuit 252 converts the DC voltage into an AC voltage with a frequency ranging from 40 to 60 kHz and outputs the resultant AC voltage to the primary electrode 254. When the AC voltage is supplied between the primary electrode 254 and the primary electrode 255, the piezoelectric substrate 253 raises the AC voltage to around 1200V and outputs the resultant voltage to the secondary electrode.

The voltage generated at the secondary electrode is supplied to the anode 258 of the cold cathode tube 256. A high AC voltage of around 1200V with a frequency ranging from 40 to 60 kHz is generated between the cathode 257 and the anode 258 of the cold cathode tube 256. Thus, the cold cathode tube 256 discharges electricity that causes mercury gas in the cold cathode tube 256 to irradiate ultraviolet rays. The ultraviolet rays activate a phosphor coated on an inner surface of the cold cathode tube and cause cold cathode tube 256 to emit light.

Since the piezoelectric substrate 253 has a U-letter-shaped section perpendicular to the direction of the length thereof, light emitted by the cold cathode tube 256 is reflected on an inner surface of the piezoelectric substrate 253. Thus, the light emitted by the cold cathode tube 256 can be effectively guided in a predetermined direction.

The length of the piezoelectric substrate 253 is substantially the same as the length of the cold cathode tube 256. Thus, the length of a high voltage wiring line can be decreased. In addition, the piezoelectric substrate 253 has a U-letter-shaped section perpendicular to the length thereof. Thus, light emitted by the cold cathode tube 256 can be effectively guided in a predetermined direction. Consequently, the cold cathode tube 256 can be effectively operated.

Figure 21:
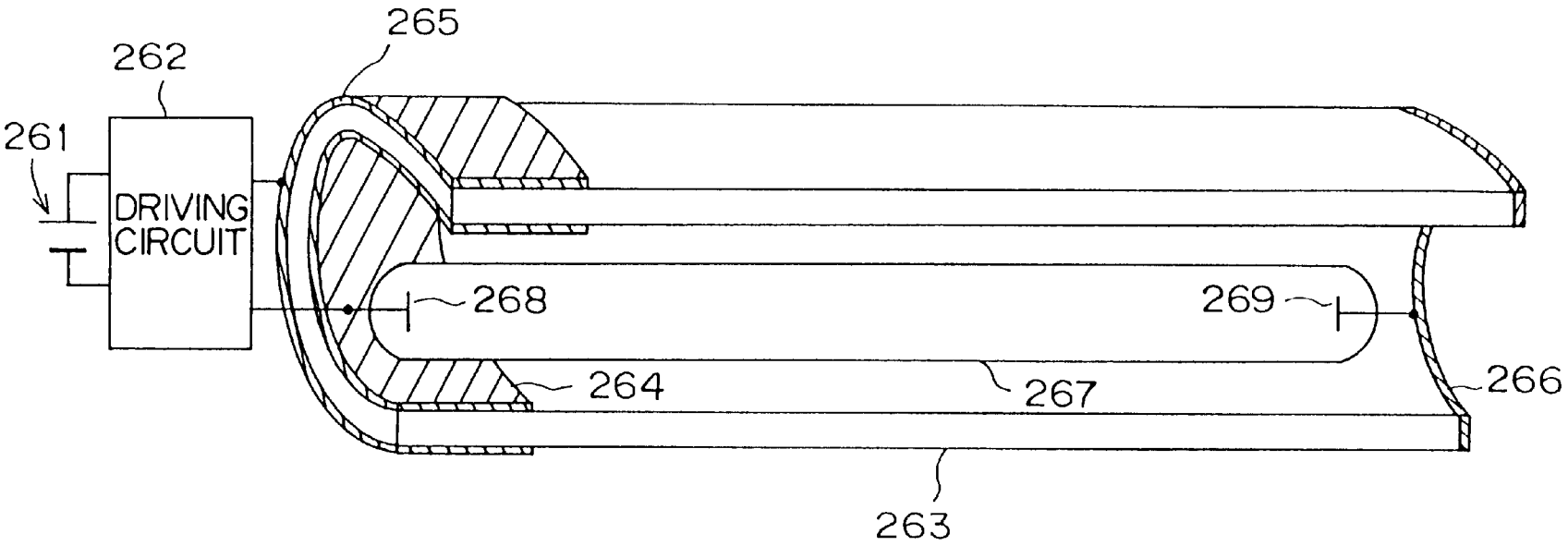
FIG. 21 is an isometric view showing an outline structure of the discharging apparatus shown in FIG. 20.

FIG. 21 is an isometric view showing an outline structure of the discharging apparatus shown in FIG. 20.

In FIG. 21, a piezoelectric substrate 263 has a U-letter-shaped section perpendicular to the direction of the length thereof. A pair of primary electrodes 264 and 265 are formed on an inner surface and an outer surface at one end of the piezoelectric substrate 263. A secondary electrode 266 is formed on the end surface of the other end of the piezoelectric substrate 263. A cold cathode tube 267 is held inside the U-letter-shaped section of the piezoelectric substrate 263. The primary electrode 264 of the piezoelectric substrate 263 is connected to a cathode 268 of the cold cathode tube 267. The secondary electrode 266 is connected to an anode 269 of the cold cathode tube 267. A DC power supply 261 is connected on the input side of a driving circuit 262. The primary electrode 265 is connected to one terminal on the output side of the driving circuit 262. The primary electrode 264 and the cathode 268 are connected to the other terminal on the output side of the driving circuit 262.

When a DC voltage of around 10V is supplied to the driving circuit 262, the driving circuit 262 converts the DC voltage into an AC voltage with a frequency ranging from 40 to 60 kHz and outputs the resultant AC voltage to the primary electrode 265. When the AC voltage is supplied between the primary electrode 264 and the primary electrode 265, the piezoelectric substrate 263 raises the AC voltage to around 1200V and outputs the resultant voltage to the secondary electrode 266.

The voltage generated at the secondary electrode 266 is supplied to the anode 269 of the cold cathode tube 267. Thus, a high AC voltage of around 1200V with a frequency ranging from 40 to 60 kHz is generated between the cathode 268 and the anode 269 of the cold cathode tube 267. Thus, the cold cathode tube 267 discharges electricity and thereby emits light. The light emitted by the cold cathode tube 267 is reflected by an inner surface of the piezoelectric substrate 263 and radiated in a predetermined direction. Thus, when the cold cathode tube 267 is used for a back-light of a liquid crystal display or the like, the piezoelectric substrate 263 can be effectively used as a light-directing lamp holder for the liquid crystal display.

Thus, since the piezoelectric substrate 263 has a U-letter-shaped section perpendicular to the direction of the length thereof, light emitted from the cold cathode tube 267 can be effectively guided in a predetermined direction. Consequently, the piezoelectric substrate can be used as a light-directing lamp holder. Thus, the size and weight of the apparatus can be reduced.

With a reflection film disposed inside the piezoelectric substrate 263, light emitted by the cold cathode tube 267 can be more effectively reflected.

Although the present invention has been shown and described with respect to best mode embodiments thereof, it should be understood by those skilled in the art that the foregoing and various other changes, omissions, and additions in the form and detail thereof may be made therein without departing from the spirit and scope of the present invention. For example, in the above-described embodiments, the structure in which a piezoelectric transformer is disposed in a discharging tube was described. However, the present invention is not limited to such a discharging tube. In other words, the present invention can be applied to any electron tube that requires a high voltage. For example, with a piezoelectric transformer disposed in a Braun tube (cathode-ray tube), a high voltage for the Braun tube can be generated therein.

As described above, according to the present invention, since a voltage is raised in a discharging tube, only with a low voltage supplied to the discharging tube, it can discharge electricity, and the discharging tube can be effectively operated.

In addition, according to an aspect of the present invention, a drive signal for driving a voltage raising unit is generated in a discharging tube, only with a low DC voltage supplied to the discharging tube, it can discharge electricity, and the discharging tube can be more effectively operated.

In addition, according to an aspect of the present invention, since a cold cathode tube is used as a discharging tube, the cold cathode tube can be effectively used for a back-light of a liquid crystal display or the like. Thus, the size, weight, and power consumption of the liquid crystal display can be reduced.

In addition, according to an aspect of the present invention, since a piezoelectric transformer is used as a voltage raising unit, a high voltage rise ratio can be easily obtained. Moreover, the size and weight of a discharging tube can be easily reduced. When the voltage raising unit is disposed in the discharging tube, the size of the discharging tube can be prevented from increasing.

In addition, according to an aspect of the present invention, since a piezoelectric transformer is enclosed in a discharging tube, only with a low AC voltage supplied to a discharging tube, a high AC voltage can be easily obtained in the discharging tube. Thus, the power consumption of the discharging tube can be reduced.

In addition, according to an aspect of the present invention, since a piezoelectric transformer is held at a node of a vibration, even if the piezoelectric transformer is held in a discharging tube, the output voltage of the piezoelectric transformer can be prevented from dropping.

In addition, according to an aspect of the present invention, since a driving circuit that drives a piezoelectric transformer is enclosed in a discharging tube, only with a low DC voltage supplied to the discharging tube, the discharging tube can discharge electricity, and the power consumption of the discharging tube can be further reduced.

In addition, according to an aspect of the present invention, since a pattern of a driving circuit is formed on a piezoelectric transformer, the size and weight of the discharging tube can be further reduced. Moreover, the discharging tube can be more effectively operated.

In addition, according to an aspect of the present invention, since the driving conditions of the piezoelectric transformer are varied corresponding to the characteristics in the real operating state of the piezoelectric transformer, the voltage rise ratio of the piezoelectric transformer due to the variation of the operating state of the piezoelectric transformer can be prevented from decreasing.

In addition, according to an aspect of the present invention, since the oscillation frequency of an oscillating circuit is varied corresponding to the variation of the resonant frequency of a piezoelectric transformer, even if the resonant characteristics of the piezoelectric transformer vary due to variations of the level of the drive signal, temperature, load, and so forth, the piezoelectric transformer can be driven at an optimum frequency. Thus, the piezoelectric transformer can be effectively operated.

In addition, according to an aspect of the present invention, since a secondary electrode of a piezoelectric transformer is used as a cathode or an anode of a discharging tube, at least one of the cathode and the anode of the discharging tube can be omitted. Thus, the power consumption of the discharging tube can be reduced. Moreover, the size and weight of the discharging tube can be reduced.

In addition, according to an aspect of the present invention, since the length of a piezoelectric substrate is substantially the same as the length of a discharging tube, a length of a high voltage wiring line can be reduced, and the discharging tube can be effectively operated.

In addition, according to an aspect of the present invention, since a piezoelectric transformer for an anode and a piezoelectric transformer for a cathode are driven with respective AC voltages whose phases are opposite to each other, the potential between the anode and the cathode of the discharging tube can be further increased. Thus, the discharging tube can more effectively discharge electricity.

In addition, according to an aspect of the present invention, since a secondary electrode is enclosed in a discharging tube and a primary electrode is disposed outside the discharging tube, the size of the discharging tube can be reduced. Even if a driving circuit is disposed on a piezoelectric substrate, the driving circuit can be disposed outside the discharging tube. Thus, the driving circuit can be prevented from being affected by the discharged electricity.

In addition, according to an aspect of the present invention, since the length of a piezoelectric transformer disposed in an inverter is substantially the same as the length of a discharging tube, the length of a wiring line connected between a secondary electrode of the piezoelectric transformer and a cathode or an anode of the discharging tube can be decreased, and the discharging tube can be effectively operated.

In addition, according to an aspect of the present invention, since the section perpendicular to the direction of the length of a piezoelectric transformer disposed in an inverter is formed in a U-letter shape, the piezoelectric transformer can be used for a lamp holder. Moreover, the length of a wiring line connected between a secondary electrode of the piezoelectric transformer and a cathode or an anode of a discharging tube can be decreased. Thus, light emitted from the discharging tube can be effectively used. Moreover, the power consumption of the discharging tube can be reduced.

What is claimed is:

1. A discharging apparatus, comprising:

a discharging tube;

transforming means, enclosed inside said discharging tube, for transforming a first voltage and a second voltage having phases opposite to each other, that are supplied to the discharging tube; and discharging means, enclosed inside said discharging tube, for discharging electricity respectively corresponding to the first voltage and the second voltage transformed by said transforming means.

2. The discharging apparatus as set forth in claim 1, wherein said transforming means raises a supplied voltage.

3. The discharging apparatus as set forth in claim 1, further comprising:

driving means, enclosed inside said discharging tube, for driving said transforming means.

4. The discharging apparatus as set forth in claim 1, wherein said discharging tube is a cold cathode tube.

5. The discharging apparatus as set forth in claim 1, wherein said transforming means is a piezoelectric transformer.

6. A discharging apparatus, comprising:

a discharging tube;

a cathode and an anode enclosed inside said discharging tube, opposite to each other;

a piezoelectric transformer, enclosed inside said discharging tube, for transforming a first voltage supplied to said anode and for transforming a second voltage supplied to said cathode; and holding means for holding said piezoelectric transformer enclosed inside said discharging tube.

7. The discharging apparatus as set forth in claim 6, wherein said holding means holds said piezoelectric transformer at a node of vibration of said piezoelectric transformer.

8. The discharging apparatus as set forth in claim 6, wherein said holding means holds a driving circuit for driving said piezoelectric transformer in said discharging tube.

9. The discharging apparatus as set forth in claim 8, wherein a pattern of said driving circuit is formed on said piezoelectric transformer.

10. The discharging apparatus as set forth in claim 8, wherein the driving circuit has an oscillating circuit and a feedback circuit for feeding back an output of said piezoelectric transformer to the oscillating circuit.

11. The discharging apparatus as set forth in claim 10, wherein the driving circuit varies the oscillation frequency of the oscillating circuit corresponding to a resonant frequency of said piezoelectric transformer.

12. A discharging apparatus, comprising:

a discharging tube having an anode and a cathode;

driving means for generating a first AC voltage and a second AC voltage having phases opposite to each other;

transforming means for transforming the first AC voltage and the second AC voltage inside said discharging tube; and outputting means for outputting a transformed first AC voltage to the cathode of said discharging tube and a transformed second AC voltage to the anode of said discharging tube.

13. A discharging method of a discharging tube, comprising:

supplying first and second AC voltages to the discharging tube;

transforming the first and second AC voltages inside the discharging tube to produce first and second transformed AC voltages; and causing the discharging tube to discharge electricity inside, respectively corresponding to the first and second transformed AC voltages.

14. A discharging method of a discharging tube, comprising:

supplying first and second DC voltages to the discharging tube;

converting the first and second DC voltages into first and second AC voltages inside the discharging tube;

transforming the first and second AC voltages inside the discharging tube to produce first and second transformed AC voltages; and causing the discharging tube to discharge electricity inside corresponding to the first and second transformed AC voltages.

* * * * *